US007766259B2

(12) United States Patent
Feith et al.

(10) Patent No.: US 7,766,259 B2
(45) **Date of Patent: *Aug. 3, 2010**

(54) SPRAY NOZZLE WITH SELECTABLE DEFLECTOR SURFACES

(75) Inventors: Raymond P. Feith, Chino Hills, CA (US); Kenneth D. Siegel, Redondo Beach, CA (US)

(73) Assignee: Rain Bird Corporation, Azusa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/208,110

(22) Filed: Sep. 10, 2008

(65) Prior Publication Data

US 2009/0008484 A1 Jan. 8, 2009

Related U.S. Application Data

(63) Continuation of application No. 11/419,693, filed on May 22, 2006.

(51) Int. Cl.

| | |
|---|---|
| ***A62C 31/02*** | (2006.01) |
| *B05B 1/34* | (2006.01) |
| *B05B 1/30* | (2006.01) |
| *B05B 1/28* | (2006.01) |

(52) U.S. Cl. ..... 239/391; 239/491; 239/392; 239/393; 239/394; 239/569; 239/571; 239/DIG. 1; 239/288; 239/288.3; 239/288.5; 239/390

(58) Field of Classification Search ..... 239/491, 239/391–394, 569, 571, 390, DIG. 1, 288, 239/288.3, 288.5

See application file for complete search history.

(56) References Cited

U.S. PATENT DOCUMENTS

| | | | | |
|---|---|---|---|---|
| 2,711,925 | A * | 6/1955 | King | 239/390 |
| 3,762,650 | A | 10/1973 | Radecki | |
| 3,958,760 | A | 5/1976 | Rosenberg | |
| 4,221,334 | A * | 9/1980 | Christopher | 239/394 |
| 4,364,519 | A | 12/1982 | Kreitzberg | |
| 4,579,285 | A | 4/1986 | Hunter | |
| 4,613,080 | A * | 9/1986 | Benson et al. | 239/542 |
| 4,834,292 | A * | 5/1989 | Dyck | 239/446 |
| 5,031,840 | A | 7/1991 | Grundy et al. | |
| 5,050,800 | A * | 9/1991 | Lamar | 239/201 |
| 5,226,602 | A | 7/1993 | Cochran et al. | |
| 5,358,180 | A * | 10/1994 | Prassas et al. | 239/391 |
| 5,456,411 | A * | 10/1995 | Scott et al. | 239/73 |
| 5,556,036 | A | 9/1996 | Chase | |
| 5,588,594 | A | 12/1996 | Kah, Jr. | |

(Continued)

OTHER PUBLICATIONS

Product Catalog, Single-Stream Sprinklers, The Toro Company, Riverside, California, Apr. 1999, 7 pages.

*Primary Examiner*—Dinh Q Nguyen
*Assistant Examiner*—Steven Cernoch
(74) *Attorney, Agent, or Firm*—Fitch, Even, Tabin & Flannery

(57) ABSTRACT

An irrigation sprinkler spray nozzle is provided that includes a first deflector surface defining a first configuration to project a fluid spray having a first distribution pattern, and a second deflector surface defining a second configuration to project a second fluid spray having a second, different distribution pattern. To select the fluid spray, the nozzle further includes a selector having a first position to select the first deflector surface and a second position to select the second deflector surface.

12 Claims, 16 Drawing Sheets

U.S. PATENT DOCUMENTS

| | | | | | |
|---|---|---|---|---|---|
| 5,642,861 | A | | 7/1997 | Ogi et al. | |
| 5,647,541 | A | | 7/1997 | Nelson | |
| D388,502 | S | * | 12/1997 | Kah, III | D23/214 |
| 5,762,269 | A | * | 6/1998 | Sweet | 239/71 |
| 5,826,797 | A | * | 10/1998 | Kah, III | 239/344 |
| 5,884,847 | A | * | 3/1999 | Christopher | 239/390 |
| 6,062,490 | A | * | 5/2000 | Katzer et al. | 239/246 |
| 6,085,995 | A | * | 7/2000 | Kah et al. | 239/237 |
| 6,123,272 | A | * | 9/2000 | Havican et al. | 239/390 |
| 6,145,758 | A | | 11/2000 | Ogi et al. | |
| 6,158,675 | A | * | 12/2000 | Ogi | 239/396 |
| 6,223,999 | B1 | * | 5/2001 | Lemelshtrich et al. | 239/391 |
| 6,237,862 | B1 | * | 5/2001 | Kah et al. | 239/391 |
| 6,443,372 | B1 | | 9/2002 | Hsu | |
| 6,601,781 | B2 | * | 8/2003 | Kah et al. | 239/391 |
| 6,736,332 | B2 | | 5/2004 | Sesser et al. | |
| 6,769,633 | B1 | * | 8/2004 | Huang | 239/457 |
| 6,820,825 | B1 | | 11/2004 | Wang | |
| 6,837,448 | B2 | * | 1/2005 | Han et al. | 239/499 |
| 7,044,403 | B2 | * | 5/2006 | Kah et al. | 239/391 |
| 2001/0013557 | A1 | * | 8/2001 | Kah et al. | 239/391 |
| 2002/0053609 | A1 | * | 5/2002 | Han et al. | 239/499 |
| 2004/0140375 | A1 | | 7/2004 | Hakala | |
| 2004/0227007 | A1 | | 11/2004 | Sesser et al. | |

* cited by examiner

SPRAY NOZZLE WITH SELECTABLE DEFLECTOR SURFACES

CROSS-REFERENCE TO RELATED APPLICATION

This application is a continuation of prior application Ser. No. 11/419,693, filed May 22, 2006, which is hereby incorporated herein by reference in its entirety.

FIELD OF THE INVENTION

The invention relates to an irrigation sprinkler and, more particularly, to a spray nozzle for an irrigation sprinkler having selectably different fluid sprays.

BACKGROUND OF THE INVENTION

In an irrigation system, drip zones are generally smaller, non-turf areas such as flowerbeds, ground cover, street medians, vegetable gardens and hanging baskets requiring a more precise amount of water delivered at or near plant root zones. Such areas are commonly watered with drip emitters, bubblers, micro-sprays, and other low-volume emission devices. These watering devices provide precise amounts of water and promote healthier plants and reduce the amount of water run-off and overspray into unwanted areas.

These watering devices are generally designed to provide a set amount of water over a predetermined ground surface area. Each particular device, however, may not be robust enough to efficiently water areas and types of vegetation for which they were not designed. For instance, a watering device designed to efficiently water a flower bed of a first area may not be suitable to efficiently water a vegetable garden of a larger, second area. Furthermore, a spray nozzle designed for a predetermined flow rate and pressure may not achieve desired distribution uniformities or precipitation rates for different flow rates and pressures.

A common shortcoming of typical watering devices, especially low-flow devices designed for drip zones, is the inability to customize the throw distances, fluid streams, spray patterns, or other fluid distribution properties once the sprinkler is installed in response to changing environmental conditions or fluid parameters. Prior attempts to provide customized distributions in an irrigation sprinkler are either cumbersome or do not project a fluid stream or spray in an efficient manner over a wide fluid flow rate or pressure range (i.e., achieving poor distribution uniformity or precipitation rates). For instance, it has been attempted to impart flexibility into a spray head using a rotating disk with multiple orifices of a different diameter to vary the flow and pressure upstream of a nozzle. Another attempt includes a rotary guide that increases the angular spray pattern in response to the circumferential position of the guide. (i.e., a 15° spread is watered upon a 15° rotation of the rotary guide, a 30° spread is watered upon a 30° rotation of the guide, and so forth.) Such spray heads, however, are still constrained with a fixed nozzle and, therefore, a fixed spray pattern that may not be efficiently designed for changes in flow rates or pressure, especially at low flows.

Other irrigation sprinklers attempt to incorporate multiple nozzles to project different spray patterns depending on which nozzle is aligned with the fluid stream. Such designs, however, are bulky and cumbersome and are not suitable for the low-flow, drip irrigation zones. These designs also require protective hoods that may interfere with the spray pattern or include multiple off-center components to house the multiple nozzles that may render the nozzle unstable and visually unpleasing for use in an irrigation system.

Accordingly, it is desired for an irrigation sprinkler that is configured to provide a selectable fluid distribution suitable for low-flow, drip irrigation zones.

DESCRIPTION OF THE PREFERRED EMBODIMENTS

Figure 1:
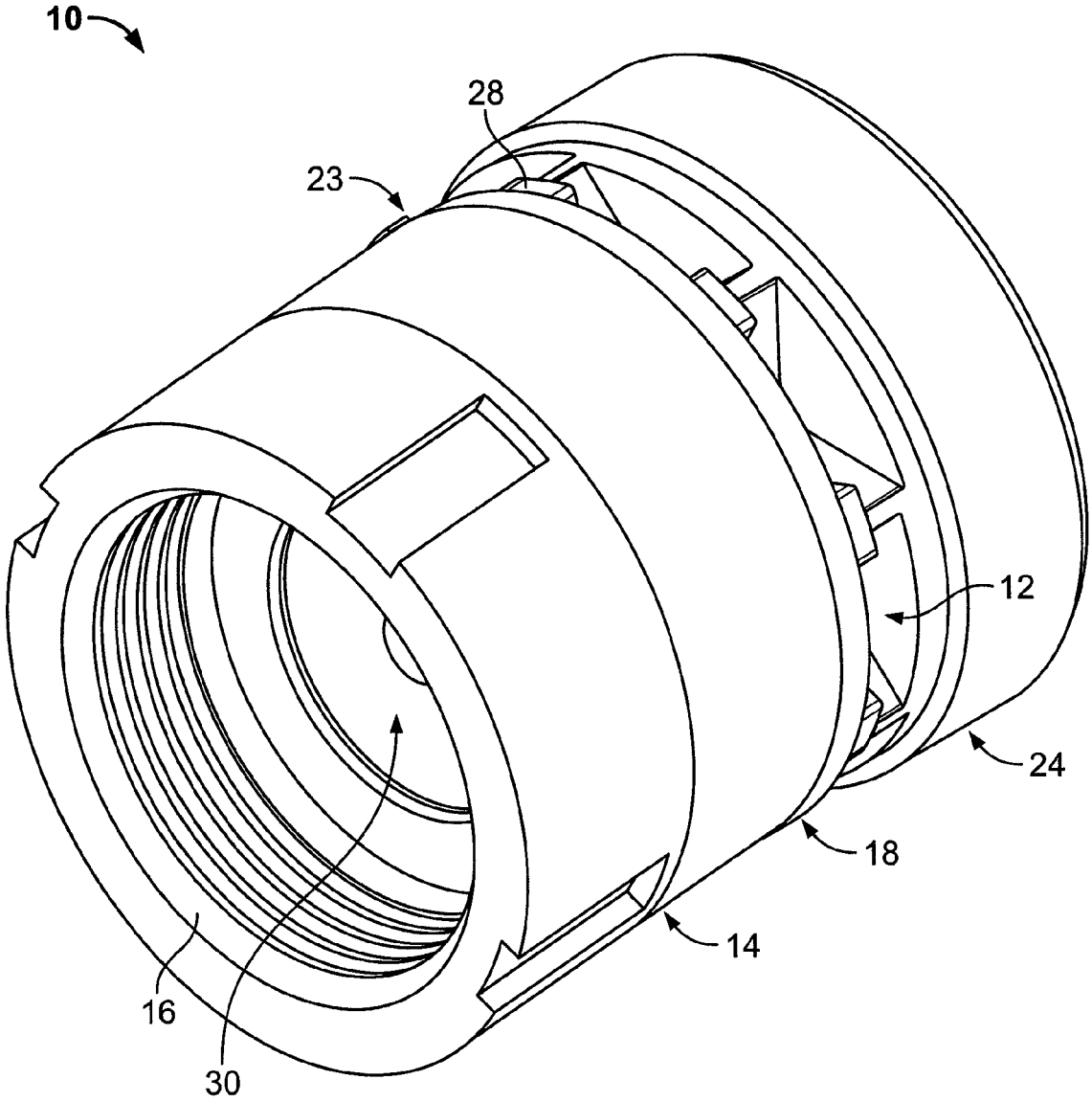
FIG. 1 is a perspective view of a nozzle assembly for an irrigation sprinkler including a base, a nozzle, and a control knob.

Referring to FIGS. 1-8, there is illustrated an irrigation sprinkler device in the form of a nozzle assembly 10, which is suitable for projecting a low volume, fluid spray to a drip irrigation zone through one or more spray nozzles 12. In general, the nozzle assembly 10 includes a base 14 having an inlet 16 configured to connect to a portion of an irrigation device, such as a pop-up riser or flexible riser (not shown). The nozzle assembly 10 further includes a nozzle or nozzle top 18 received in an outlet 20 of the base 14. The nozzle 18 includes one or more ports or throughbores 22 for directing fluid upwardly from the base 14 to the spray nozzles 12. Opposite the base 14, the nozzle assembly 10 terminates in a control knob 24, which defines at least one, and preferably, a plurality of selectable deflectors or deflector surfaces 26 on an underside thereof to form the spray nozzles 12.

Preferably, the plurality of deflectors 26 include more than one distinct configuration such that the nozzle assembly 10 may project more than one distinct spray pattern or throw distance depending on which deflector 26 is in fluid communication with the nozzle port 22. To select a particular spray pattern or throw distance, the nozzle assembly 10 is adjusted such that a particular deflector 26 designed to project the desired spray pattern or throw distance is in fluid communication with the nozzle port 22. For example, through positioning of the control knob 24, one of the deflectors 26 having a first configuration may be selected for fluid communication with the nozzle port 22 so that the spray nozzle 12 projects a first spray pattern or throw distance. By moving the control knob 24 to a different position, a different deflector 26 with a second configuration may be selected for fluid communication with the nozzle port 22 so that the spray nozzle 12 projects a second, different spray pattern or throw distance.

In one form, the deflector 26 in fluid communication with the nozzle port 22 is selected through a rotational movement of the control knob 24 about a vertical axis X of the nozzle assembly 10 relative to the nozzle 18. That is, rotation of the control knob 24 permits the alignment of any one of the plurality of deflectors 26 to be in fluid communication with the nozzle port 22. However, such movement also forms a rotational interface 23 (FIG. 4) between the control knob 24 and the nozzle 18 that may create small gaps or other misalignments between the contacting surfaces that may leak during fluid distribution. As a result, the nozzle assembly 10 also preferably includes a base plate or flow-control device 28 disposed between the nozzle 18 and the control knob 24. The flow-control device 28 rotates with the knob 24, and enhances sealing between the deflectors 26 and the nozzle 18 in order to minimize, and preferably eliminate, any leaking of fluid between the nozzle 18 and the knob 24 along the interface 23 during fluid distribution. In one form, as further described below, the enhanced sealing results from a venturi effect as the fluid flows upwardly through the flow-control device 28.

The nozzle assembly 10 also preferably includes a secondary flow-control device 30 contained within the base 14 to maintain a constant flow rate in the nozzle assembly 10 over a range of fluid pressures (i.e., about 15 psi to about 50 psi). In one form, the secondary flow-control device 30 is a flexible washer defining a variable aperture 32 therein. The variable aperture 32 defines an inlet 32*a* and an outlet 32*b* that expands or contracts depending on the fluid pressure in the nozzle assembly 10 in order to maintain a relatively constant flow rate at spray nozzles 12.

Figure 2:
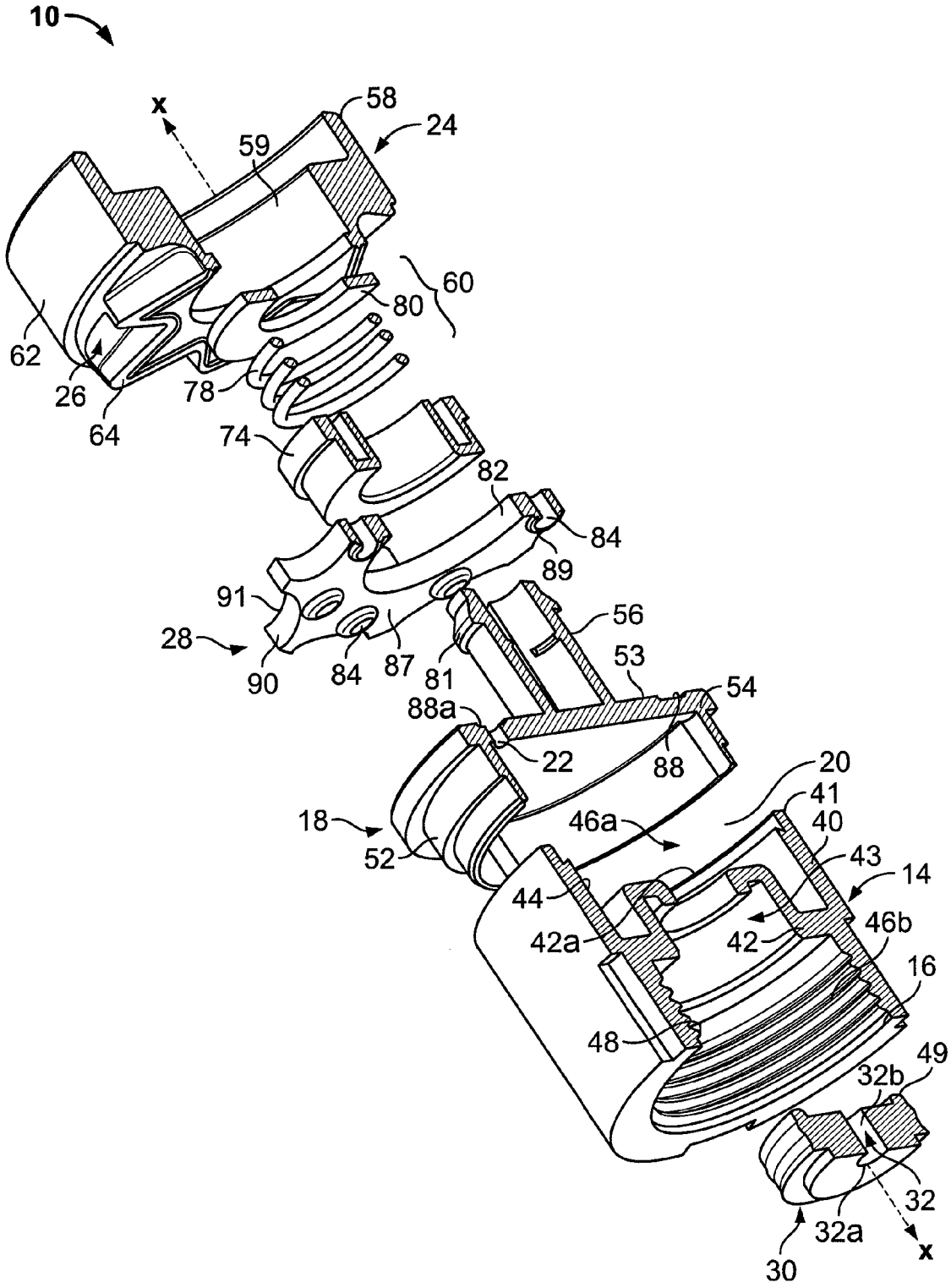
FIG. 2 is an exploded, cross-sectional view of the nozzle assembly of FIG. 1.
Figure 3:
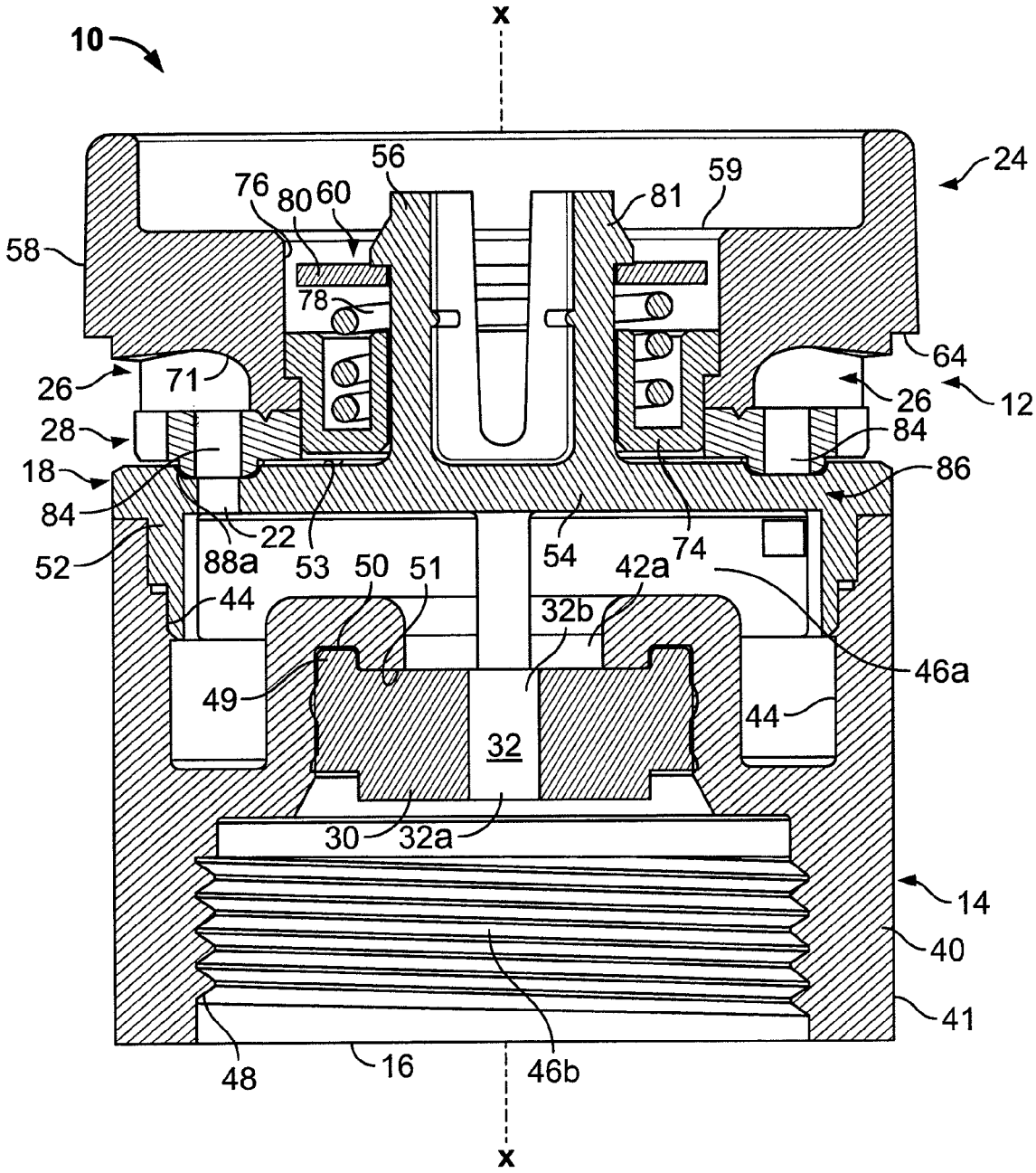
FIG. 3 is a cross-sectional view of the nozzle assembly of FIG. 1.

Referring more specifically to FIGS. 2 and 3, the base 14 includes an annular wall 40 to form a generally cylindrical housing 41. Intermediate the base inlet 16 and the base outlet 20, the housing 41 also includes a floor 42 that extends inward from the inner wall surface 44 to divide the base 14 into an upper chamber 46*a* and a lower chamber 46*b*. The floor 42 includes a recess 43 sized to receive the secondary flow control device 30 therein and defines a central opening 42*a* for fluid flow upwardly therethrough. The lower chamber 46*b* preferably includes inner threads 48, which can be threadably received on corresponding threads of a pop-up riser or other portion of a sprinkler system device (not shown).

With the secondary-flow control device 30 received in the recess 43, the variable aperture 32 is preferably coaxial with the central opening 42*a* of the base floor 42. In this manner, fluid may flow directly through both the variable aperture 32 and the central opening 42*a* with minimal interference. To help align the secondary flow-control device 30 in the recess 43, the secondary-flow control device 30 includes an optional annular rib 49 that seats within an annular groove 50 disposed at the outer periphery of an upper surface 51 of the recess 43 (FIG. 3). However, the secondary-flow control device 30 may be received against the upper surface 51 using a variety of mechanisms.

As noted above, the secondary flow-control device 30 is preferably formed from a flexible or resilient material, such as EPDM. Such material permits the device 30 to flex or deform upon increased fluid pressure. The central opening 42*a* preferably has a size (i.e., about 0.2 inches in diameter) such that the secondary flow-control device 30 may flex or deform downstream into the central opening 42*a* upon increased fluid-pressure. With such downstream deformation of the secondary flow-control device 30 upon increased fluid pressure, the inlet 32*a* constricts and the outlet 32*b* expands. Therefore, an increased pressure drop across the inlet 32*a* is formed and a more constant pressure and flow rate downstream is maintained. As the fluid pressure drops, the secondary flow-control device 30 relaxes back to its un-deformed condition wherein the inlet 32*a* and outlet 32*b* are generally the same.

It will be appreciated that the size of the variable aperture 32 and thickness of the secondary flow-control device will vary depending on the fluid pressure and flow rates of the desired application. However, in a preferred application designed to maintain about 15 psi to about 50 psi at about 7 to about 28 gallons per hour (with a matched precipitation rate based on the number of ports 22), the secondary flow-control device is about 0.12 inches to about 0.13 inches thick with the variable aperture 32 having a diameter of about 0.034 inches to about 0.070 inches. The secondary-flow control device 30 is integral with the nozzle assembly 10 upstream of the spray nozzles 12, rather than, for example, being included in a separate filter upstream of the entire nozzle assembly or being located at the nozzle outlet.

Referring again to FIGS. 2 and 3, the nozzle 18 is received in the base outlet 20 and includes an upper disk portion 54 and an annular wall portion 52 depending below the upper disk portion 54. The annular wall portion 52 may be stepped inwardly in order to match a corresponding shape on the base inner wall 44 in the upper chamber 46*a* in order to provide a more secure or fluid-tight fit. Extending above an upper surface 53 of the nozzle disk portion 54 is a generally cylindrical post 56 configured to rotatably attach the control knob 24, which will be described more fully below. The nozzle 18 is preferably secured to the base 14 to form a fluid-tight seal, such as by sonic welding or other known securing methods suitable for forming a fluid tight seal.

Figure 8:
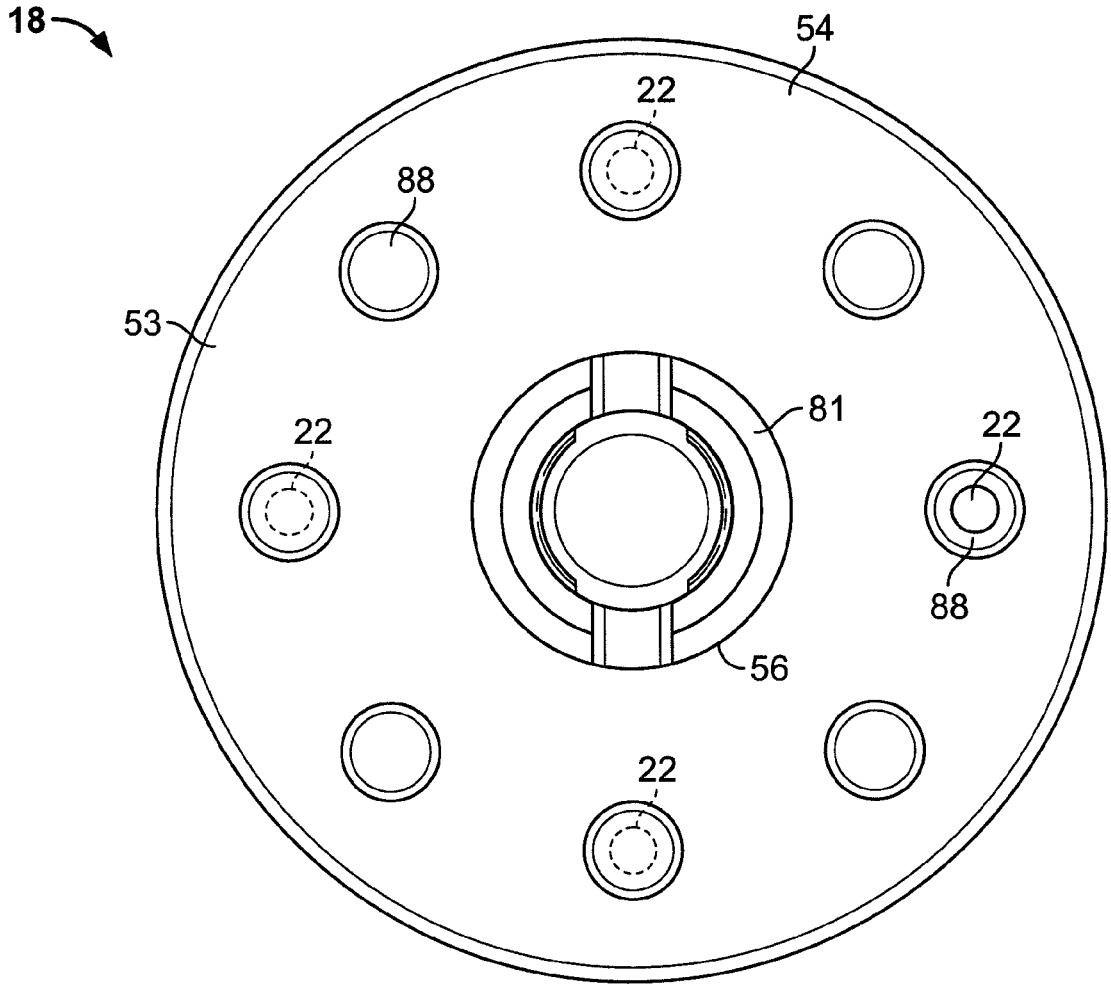
FIG. 8 is a top plan view of the nozzle for the nozzle assembly of FIG. 1.
Figure 9:
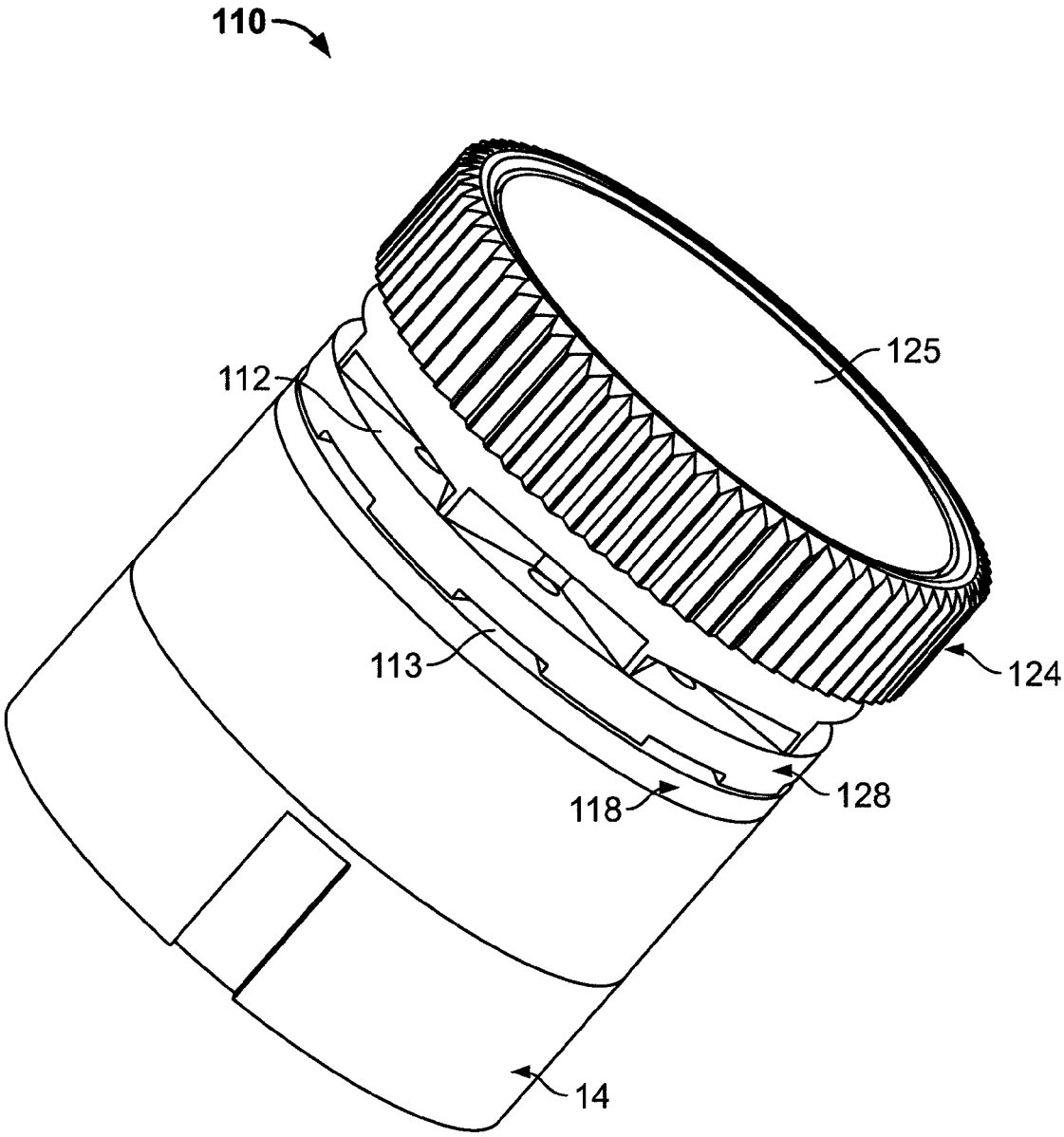
FIG. 9 is a perspective view of another nozzle assembly for an irrigation sprinkler including a base, a nozzle, a base plate, a control knob, and a cap.

The upper disk portion 54 defines the one or more nozzle ports 22 therein. As illustrated in FIGS. 2, 3 and 8, the nozzle 18 includes one port 22 extending through the disk 54. This configuration will project a single spray via a single nozzle 12 to cover a quarter pattern or about 90° of ground surface area. However, other configurations of the nozzle 18 and the port 22 are also possible. For instance, as illustrated by the optional ports 22, which are shown in phantom in FIG. 8, the disk portion 54 may include more ports 22 circumferentially spaced thereabout to cover an increased ground surface area. For instance, two ports would project two fluid sprays to cover a half-pattern (i.e., about 180°), three ports would project three fluid sprays to cover a three-quarter pattern (i.e., about 270°), and four ports would project four fluid sprays to cover a full pattern (i.e., about 360°). After positioning of the control knob 24, each port would be in fluid communication with a deflector 26 to form its corresponding fluid spray.

As illustrated in FIGS. 2-7, the control knob 24 is preferably a generally cylindrical member 58 defining a central opening 59. The control knob opening 59 rotatably receives the post 56 and also houses a biasing component 60 therein. The biasing component 60 biases the control knob 24 towards the upper surface 53 of the nozzle 18 once the desired deflector 26 is selected to be in fluid communication with the port 22. An outer surface 62 of the control knob 24 also may include as an option ribs, texture, or other tactile surface feature to form a gripping surface for ease of gripping and rotating the control knob 24 relative to the nozzle 18.

A lower surface 64 of the control knob 24 defines the plurality of deflectors 26 thereon, as best illustrated in FIGS. 3-7. Most preferably, the lower surface 64 defines eight discrete deflectors 26 (i.e., 26*a*, 26*b*, 26*c*, 26*d*, 26*e*, 26*f*, 26*g*, and 26*h*) circumferentially spaced about the control knob 24. With the illustrated embodiment of the nozzle 18 defining one port 22, rotationally positioning the control knob 24 associates one of the deflectors 26 to be in fluid communication with the one port 22. Optionally, with a nozzle 18 defining two ports 22, rotationally positioning the control knob 24 associates two of the deflectors 26 to each be in fluid communication with one of the two ports 22. Likewise, with three ports 22, rotationally positioning the control knob 24 associates three of the deflectors 26 to each be in fluid communication with one of the three ports 22 and so forth. Preferably, the nozzle 18 include up to a total of four ports 22. As a result, with more deflectors 26 than ports 22, once the control knob 24 is positioned, some deflectors 26 will not be in fluid communication with a port 22.

Figure 5:
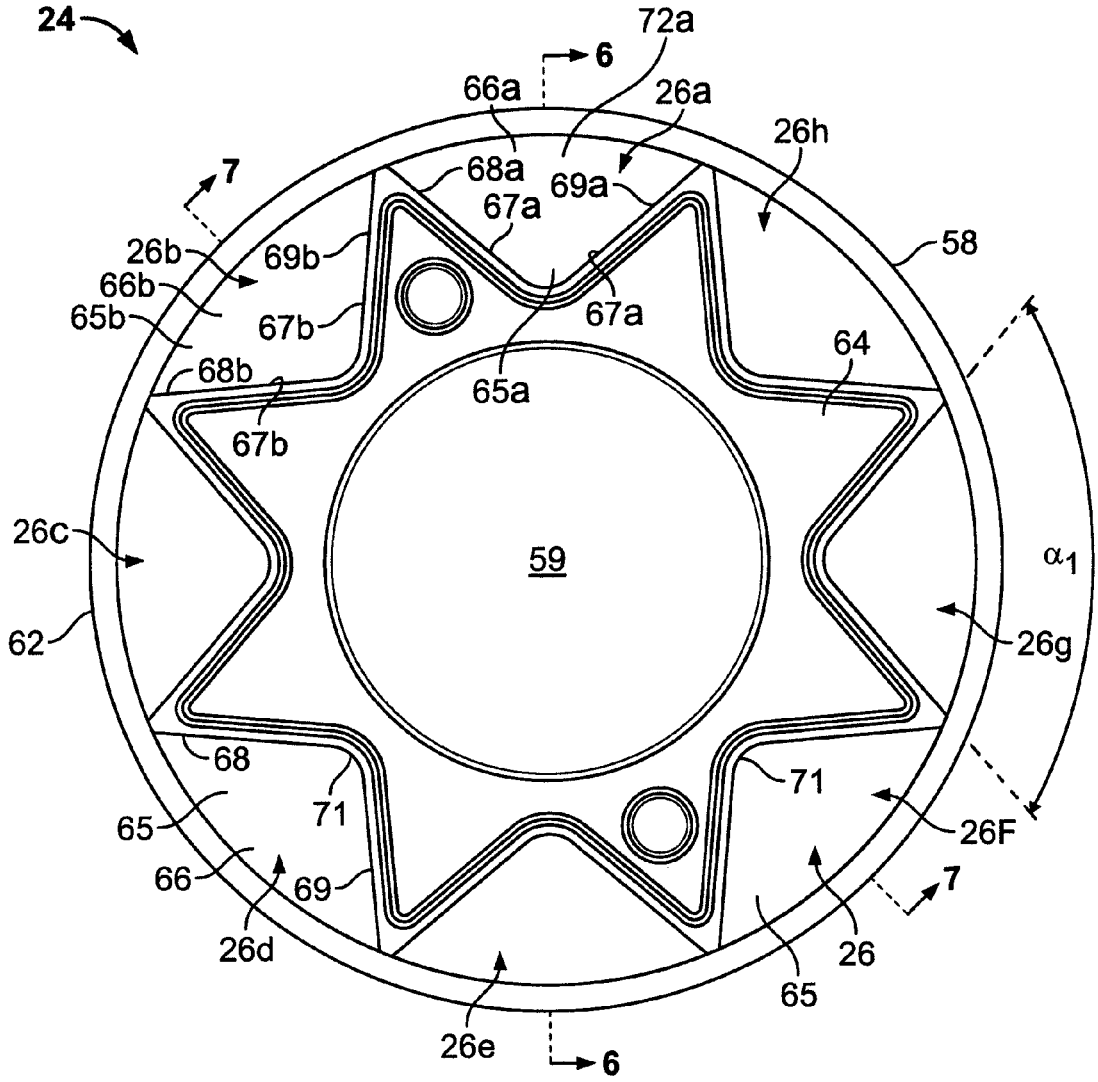
FIG. 5 is a bottom plan view of the control knob for the nozzle assembly of FIG. 1.

More specifically, as best shown in FIG. 5, each deflector 26 is a generally wedge- or triangular-shaped recess 65 in the knob lower surface 64. For instance, the recess 65 is defined by an upper wall 66 and facing side walls 68 and 69 depending therefrom. To form the wedge-shape, the facing side walls 68 and 69 intersect at point 71 and extend radially outwardly towards the knob outer surface 62 at a sweep angle $\alpha 1$. In a preferred configuration, the deflector side walls 68 and 69 form a sweep angle $\alpha 1$ of about 90° to about 100° in order to spray a generally quarter pattern or about 90° to about 100° of ground surface area about the spray nozzle assembly 10. Optionally, other deflectors 26 may form a different sweep angle $\alpha 1$ in order to form a fluid spray to cover a different ground surface area.

The recess 65 also includes a curved transition portion 71 that joins the upper wall 66 and the two facing side walls 68 and 69 about the intersection point 71. As best illustrated in FIGS. 3 and 6-7, the curved transition area 71 is generally aligned axially with the port 22 and, therefore, more smoothly transitions the fluid flow from the generally upwardly direction through the port 22 to the generally outwardly direction of the spray nozzle 12.

Preferably, the control knob 24 includes at least two distinct deflectors 26*a* and 26*b* formed from two distinct recess configurations 65*a* and 65*b*, respectively, to form two different fluid spray patterns and/or distances for fluid distribution. For instance, the recess shape 65*a* of the deflector 26*a* is configured to project a fluid spray pattern to cover a generally square ground surface area extending a total distance from the nozzle assembly about 2 to about 3 feet. On the other hand, the shape 65*b* of the other deflector 26*b* is configured to project a fluid spray pattern to cover a generally square ground surface area extending a total distance from the nozzle assembly about 3 to about 5 feet.

Figure 4:
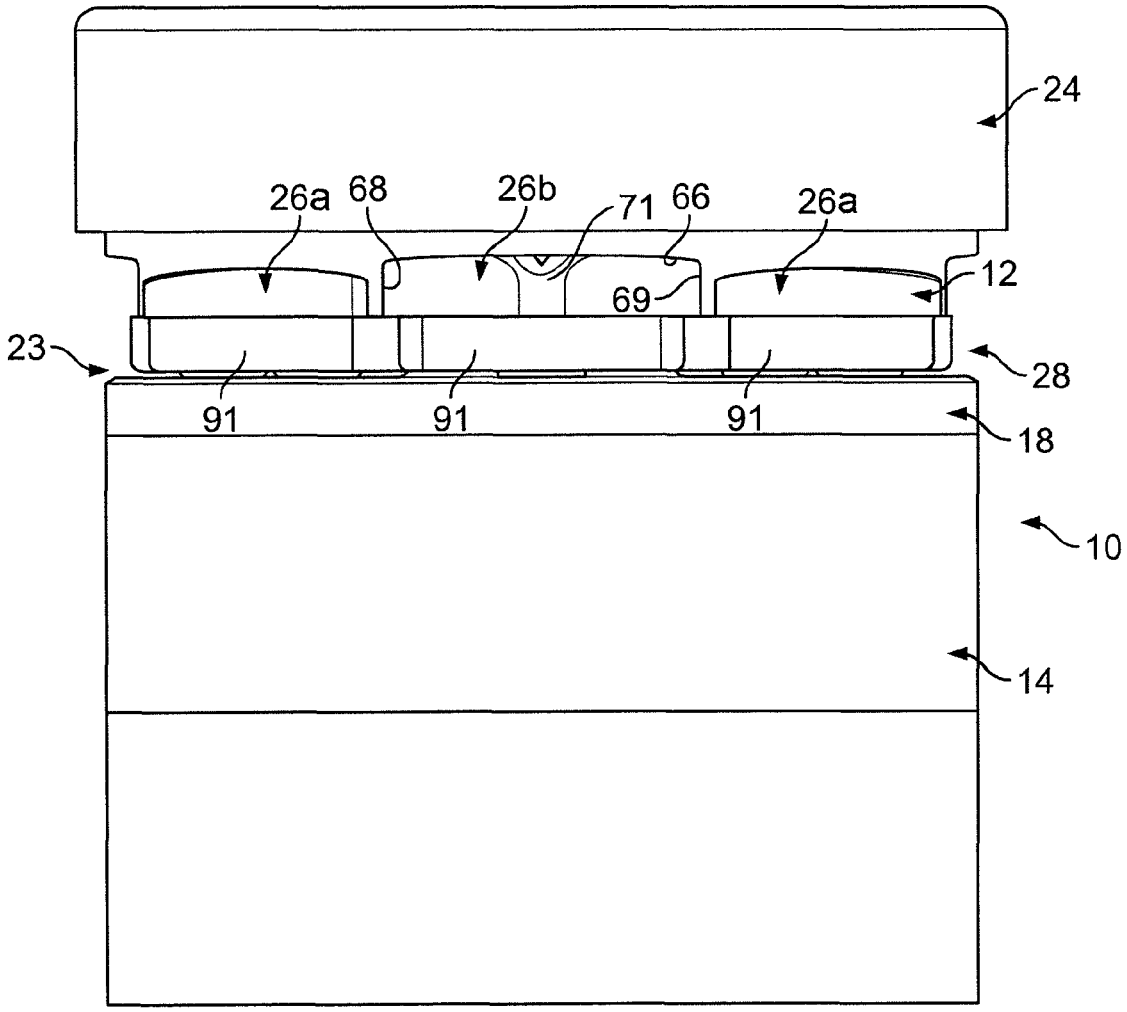
FIG. 4 is an elevational view of the nozzle assembly of FIG. 1.
Figure 6:
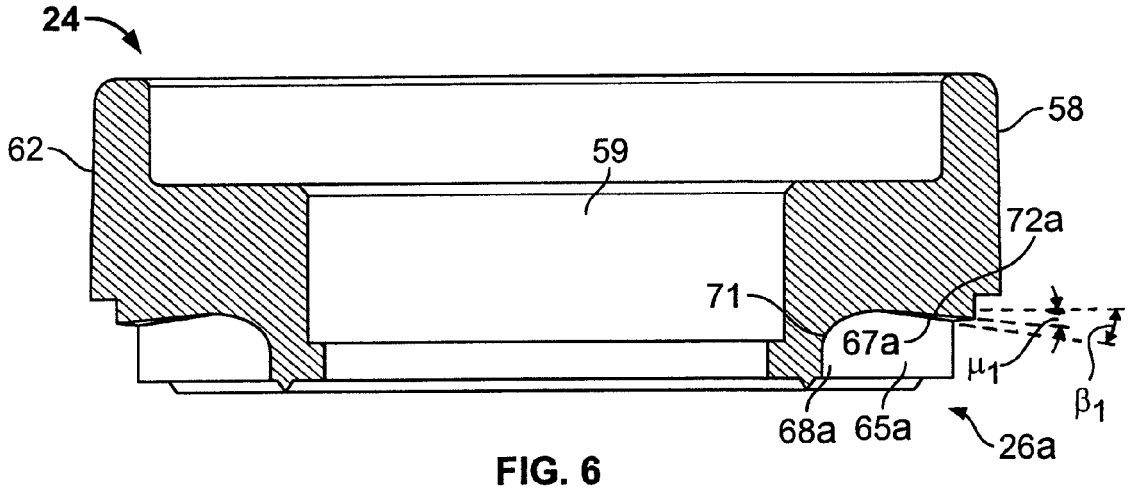
FIG. 6 is a cross-sectional view of the control knob of FIG. 5 taken along line 6-6 in FIG. 5.
Figure 7:
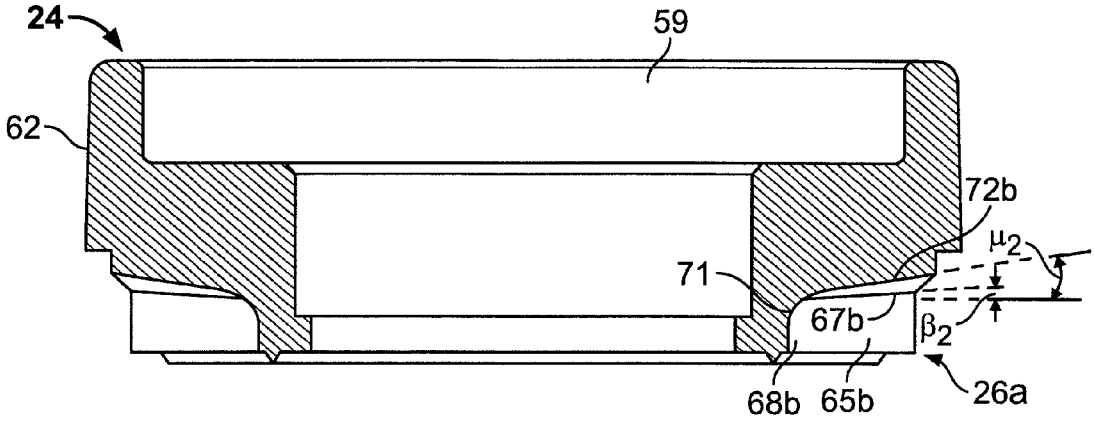
FIG. 7 is a cross-sectional view of the control knob of FIG. 5 taken along line 7-7 in FIG. 5.

As shown in FIGS. 4 and 6-7, the recess upper walls 66 are preferably lofted to have a different trajectory angle at the edges than at the center to achieve such spray patterns. For instance, as best illustrated in FIG. 6, the recess 65*a* defines a downward trajectory angle $\beta 1$ between about 3° to about 8° at a transition edge 67*a* between an upper wall 66*a* and the opposing side walls 68*a* and 69*a*. At a central portion 72*a* of the upper wall 66*a* between the transition edges 67*a*, the recess 65*a* defines a downward trajectory angle $\mu 1$ between about 1° to about 5° to form the lofted configuration of deflector 26*a*. This lofted recess configuration projects a fluid spray to cover a generally square ground surface area extending a total distance of about 2 to about 3 feet from the spray nozzle assembly 10.

On the other hand, to project a generally square fluid spray pattern a total distance of about 3 to about 5 feet, the recess 65*b* of the other deflector 26*b* has a different lofted configuration. For instance, as best illustrated in FIG. 7, the recess 65*b* defines an upwardly trajectory angle $\beta 2$ between about 11° to about 15° at a transition 67*b* between an upper wall 66*b* and the opposing side walls 68*b* and 69*b*. At a central portion 72*b* of the upper wall 66*b* between the transition edges 67*b*, the recess 65*b* defines an upwardly trajectory angle $\mu 2$ between about 16° to about 19° to form the different lofted configuration of deflector 26*b*.

Figure 7A:
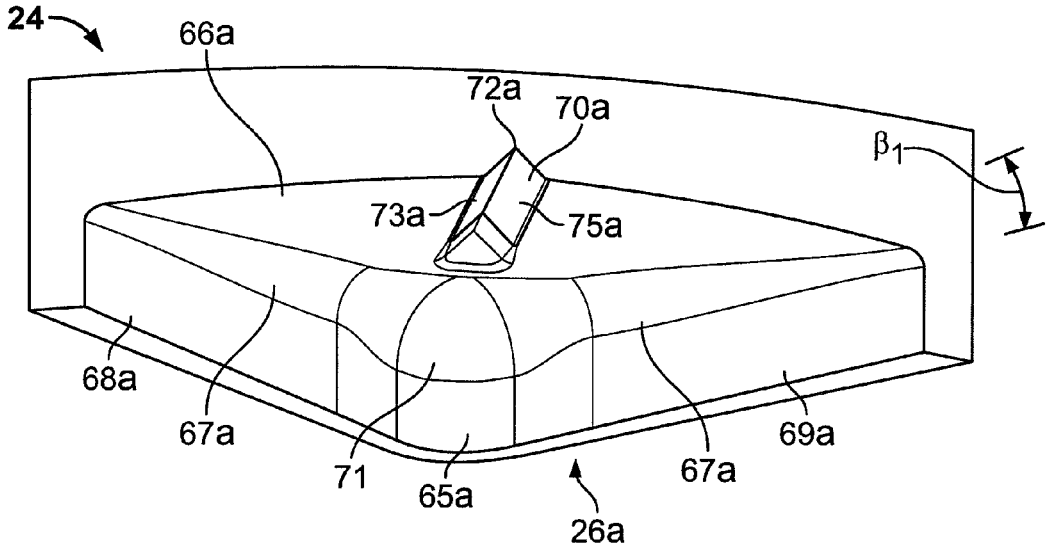
FIG. 7A is a perspective view of a portion of the nozzle assembly showing details of an exemplary deflector surface.
Figure 7B:
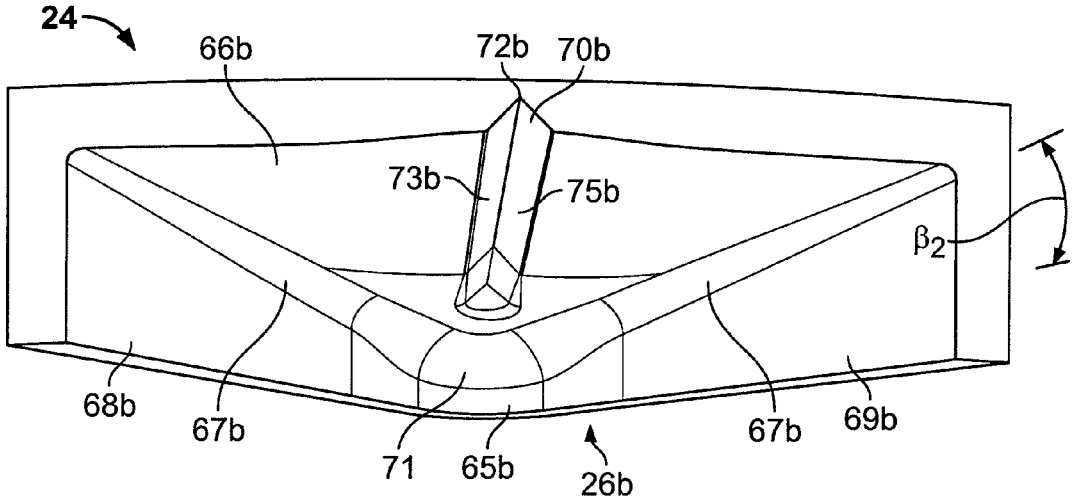
FIG. 7B is a perspective view of another portion of the nozzle assembly showing details of another exemplary deflector surface.

Referring to FIGS. 7A and 7B, details of optional features of the deflectors 26*a* and 26*b* are illustrated. In FIG. 7A, a first portion of the control knob 24 is illustrated showing only the deflector 26*a* and recess 65*a* with an optional flow-direction channel 70*a* located in the upper wall 66*a* generally aligned with the central portion 72*a*. The flow-direction channel 70 is defined by a notch in the upper wall 66*a* formed from inwardly angled channel walls 73*a* and 75*a*. In FIG. 7B, a second portion of the control knob 24 is illustrated showing only the deflector 26*b* and recess 65*b* with a similar flow-direction channel 70*b*. The flow-direction channels 70*a* and 70*b* help focus and direct the fluid within the respective deflector 26*a* or 26*b* in order to project the fluid spray to the far corners of the generally square ground surface area.

As will be appreciated by one skilled in the art, different spray patterns and distances can be obtained by varying the shapes and angles of the recess 65 as described above. As such, the details above are merely provided as one example to achieve two types of spray patterns and distances based on a nozzle about 6 inches above ground level. One skilled in the art will appreciate that the configuration of the recess may need to be altered if the nozzle extends a different height above ground level. Moreover, the shapes, angles, and geometry of the recess 65 can also be varied as desired to achieve other types of spray patterns and/or distances. For instance, generally decreasing the angles $\mu$ and $\beta$ will generally increase the total throw distance.

Referring to FIGS. 4 and 5, the deflector 26*a* and the deflector 26*b* preferably alternate about the circumference of the control knob 24. In this manner, either increased or decreased spray distances may be selected by rotating the control knob 24 either clockwise or counter-clockwise relative to the nozzle 18 to align the desired deflector 26 (i.e., either deflector 26*a* or deflector 26*b*) to be in fluid communication with the port 22.

In addition, with the preferred eight deflectors 26 and four total ports 22, as optionally described above, each port 22 may be associated with one of the two adjacent deflectors 26—a deflector 26*a* or a deflector 26*b*—as desired to project the predetermined distance, depending on the rotational position of the knob 24 and which deflector 26 is in fluid communication with each port 22. As will be appreciated by one skilled in the art, to achieve various spray patterns and distances, the sweep and trajectory angles of the deflector 26 as well as the number of deflectors can be varied within the scope and concept of the nozzle assembly 10.

The desired deflector 26 is preferably selected through rotation of the control knob 24 relative to the nozzle 18. To accomplish such movement, the control knob 24 is rotationally coupled to the post 56 and also biased downwardly towards the nozzle disk 54 through the biasing mechanism 60. In one form, as illustrated in FIGS. 2 and 3, the biasing mechanism 60 preferably includes an annular retainer 74 nested within a stepped inner surface 76 of the control knob 24 within the knob central opening 59. Housed within the retainer 74 is a biasing member 78, such as a coil spring. The biasing mechanism 60 also includes a flat washer 80 on top of the biasing member 78 that engages with an outwardly extending annular barb or flange 81 at a terminal end portion of the post 56. The biasing member 78 together with the engagement of the washer 80 against a lower surface of the flange 81 biases the retainer 74 in a downward direction. The lower end of the biasing member 78 seats in an annular recess 76 defined by the retainer 74. The nested interface between the retainer 74 and knob 24 also aids in biasing the lower surface 64 of the knob 24 downwardly toward the nozzle disk 54. Optionally, as discussed in more detail below with FIGS. 10 and 11, the retainer 74 may also be formed integrally with the control knob 24 as illustrated with control knob 124 that includes a knob portion 124*a* and an integral retainer portion 124*b*.

To select one of the deflectors 26 (i.e., either deflector 26*a* or deflector 26*b*) to be in fluid communication with the port 22, a user grasps the outer surface 62 of the knob 24 and pulls the knob 24 away from the nozzle 18 to counter bias the biasing mechanism 60. The knob 24 can then be rotated either clockwise or counter-clockwise to select a different deflector 26 to be in fluid communication with the port 22. Once the desired deflector 26 is selected, the user releases the knob 24 and the biasing mechanism 60 again biases the knob 24 downwardly toward the nozzle 18.

As illustrated in FIGS. 1 and 3, the nozzle assembly 10 also preferably includes the base plate or flow-control device 28 between the nozzle 18 and the knob 24. The base plate 28 minimizes, and preferably, eliminates fluid leaking at the rotational interface 23 between the base plate 28 and the nozzle 18. In one form, the base plate 28 is a washer-shaped disk 82 secured to the lower surface 64 of the control knob 24. As such, the base plate 28 rotates relative to the nozzle 18 along with the control knob 24. Preferably, the base plate 28 is secured to the control knob 24 through a sonic weld but may be joined by any method that forms a fluid tight seal therebetween.

The base plate 28 defines a plurality of secondary ports or throughbores 84 wherein one throughbore is in fluid communication with one of the deflectors 26 on the control knob 24. Upon selection of the desired deflector 26 with the port 22, the respective secondary port 84 also is in fluid communication with the port 22 and guides fluid from the port 22 upwardly to the deflector 26. To minimize and preferably eliminate fluid leaking at the interface 23, the secondary ports 84 generally have a diameter larger than the nozzle port 22 to produce a venturi effect that lowers the pressure at the interface 23 to form a partial vacuum.

For example, with a nozzle port 22 having a diameter of about 0.04 inches, the secondary ports 84 typically would have a diameter from about 0.047 to about 0.05 inches in order to form the desired pressure drop and partial vacuum at the interface 23. The partial vacuum generally prevents fluid from leaking outwardly at the interface 23 because air is drawn inwardly to the secondary port 84 through any gaps or other misalignments at the interface 23 thereby reducing the ability of fluid to flow out at the interface 23.

To ensure that a deflector 26 is properly aligned with a nozzle port 22, the rotational interface 23 preferably includes a plurality of stop members 86, as illustrated in FIGS. 2 and 3. In one form, the stop members 86 includes a recess or well 88 and a corresponding detent 89 that is configured to be received in the recess 88. As illustrated in FIG. 8, a plurality of recesses 88 are defined in the disk upper surface 53 and a corresponding plurality of detents 89 extend below a lower surface 87 of the base plate 28. In combination with the biasing mechanism 60, the stop members 86 (i.e., the detents 89 and the recess 88) form an audible indication, such as a "click" or "snap," when the detents 89 slide into the recesses 89 when the control knob 24 is correctly positioned with one desired deflector(s) 26 in fluid communication with the desired port(s) 22.

As further illustrated in FIGS. 2-3 and FIG. 8, a recess 88*a* surrounds the port 22 and the detents 89 surround the secondary ports 84. Such configuration, however, is not required, but only a preferred construction of the stop member 86 in the nozzle assembly 10. Alternatively, for instance, the recess(es) 88 may be defined by the lower surface 87 of the base plate 28, and the detents 89 may extend from the nozzle upper surface 53. In addition, other types of stopping members or mechanisms that permit rotational alignment between two structures may also be used on the nozzle assembly 10 in order to ensure proper alignment between the desired deflector and nozzle port(s). The stopping members 86, as discussed above, may also be included in the alternative embodiments that are further discussed below.

To project a fluid stream close in to the nozzle assembly 10, the base plate 28 optionally defines clearances 90 in the form of inwardly curved notches 91. As best illustrated in FIGS. 2 and 4, the notches 91 curve inwardly on the base plate 28 generally between the deflector side walls 68 and 69. Each deflector 26 may include a corresponding clearance 90 on the portion of the base plate 28 adjacent the deflector 26. In some instances, the clearances 90 permit the fluid spray to project downwardly to ground areas close to the nozzle assembly 10.

Referring now to FIGS. 9-15, a second embodiment of a spray nozzle assembly 110 is illustrated and includes at least one primary spray nozzle 112 and at least one secondary spray nozzle 113. The nozzle assembly 110 also includes selectable deflector surfaces 126 similar to nozzle assembly 10, but in some instances, uses the two spray nozzles 112 and 113 to achieve extended and close-in fluid sprays rather than the clearances 90 in the base plate 28. For instance, in one form, the primary spray nozzle 112 projects a fluid spray a first distance from the nozzle assembly, such as a total distance from the spray nozzle of between about 2 and about 3 feet, and the secondary spray nozzle 113 projects a fluid spray a second, shorter distance, such as a total distance under about 2 feet from the spray nozzle assembly 110.

The nozzle assembly 110 preferably includes the base 14, and optionally, the secondary flow-control device 30 therein similar to the nozzle assembly 10. The nozzle assembly 110 also includes a nozzle 118, a base plate or flow-control device 128, and a control knob 124, each of which include additional features not found on like components in the nozzle assembly 10. The additional features are included to form both the primary spray nozzle 112 and the secondary spray nozzle 113 and will be further described below.

Figure 10:
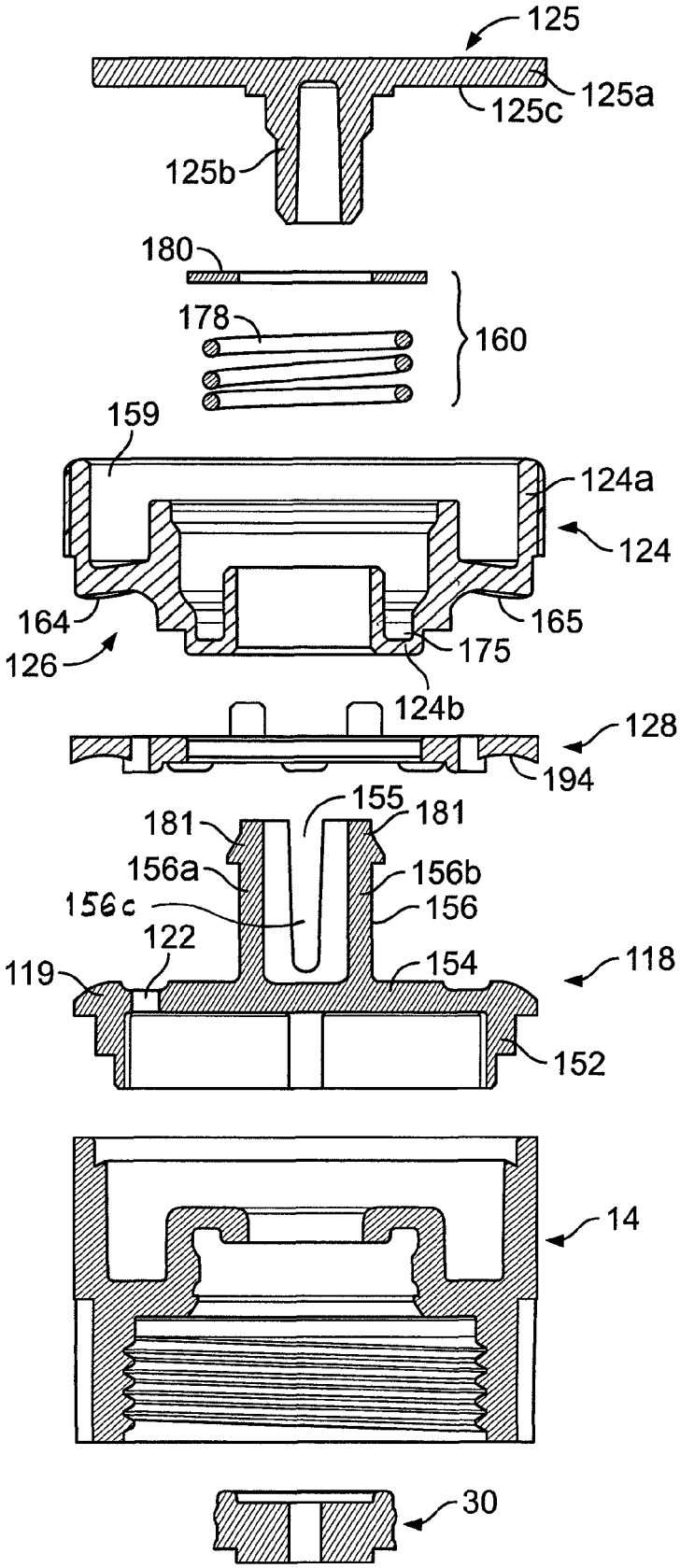
FIG. 10 is an exploded, cross-sectional view of the nozzle assembly of FIG. 9.

More specifically, referring to FIG. 10, the nozzle 118 includes an upper disk portion 154 and an annular flange 152 depending from a lower surface of the disk 154. The flange 152 is sized for receipt in the base 14 with a fluid-tight arrangement, such as by a friction fit, sonic welding, or other suitable fluid-tight securing methods. Extending above an upper surface 153 of the disk portion 154 is an attachment post 156, which rotatably secures the control knob 124 to the nozzle 118. Preferably, the post 156 is formed from a slit post construction consisting generally of two facing arcuate fingers 156*a* and 156*b* that are spaced from each other to define a central space 155 therebetween.

The disk 154 includes at least one port or throughbore 122 for the passage of fluid when in fluid communication with a spray nozzle 112 or 113. As with the nozzle 18, the nozzle 118 may also include additional ports 122 as desired. With the addition of the secondary spray nozzles 113, an outer periphery 119 of the nozzle 118 is beveled or curved downwardly. Such configuration aids in close-in fluid sprays projected from the secondary nozzle 113.

The control knob 124 is similar to knob 24 in that is defines a plurality of deflectors 126 on a lower surface 164 thereof that can be selected for fluid communication with the port 122. The deflectors 126 are formed from recesses 165 that preferably have at least two distinct configurations to form at least two distinct spray patterns depending on which deflector 126 is in fluid communication with the port 122. The geometries and shapes of the recesses 165 may be similar to the recesses 65 formed on the control knob 24 and, therefore, will not be further described with this embodiment. As discussed previously, the knob 124 may also be incorporated in the other embodiments described herein.

While the nozzle assembly 110 is illustrated in FIGS. 9-15 with a secondary spray nozzle 113 associated with each primary spray nozzle 112 (i.e., each deflector 126), the nozzle assembly 110 may also include primary spray nozzles 112 without an associated secondary spray nozzle 113. For instance, similar to the previous embodiment, one of the deflectors 126 has a configuration to project a fluid spray a total distance of about 3 to about 5 feet and another of the deflectors 126 has a configuration to project a fluid spray a total distance of about 2 to about 3 feet. One possible configuration of the nozzle assembly 110 includes the secondary spray nozzle 113 only associated with the deflectors 126 that project a fluid spray about 2 to about 3 feet, while the other deflectors 126 are not associated with a secondary spray nozzle 113.

Figure 11:
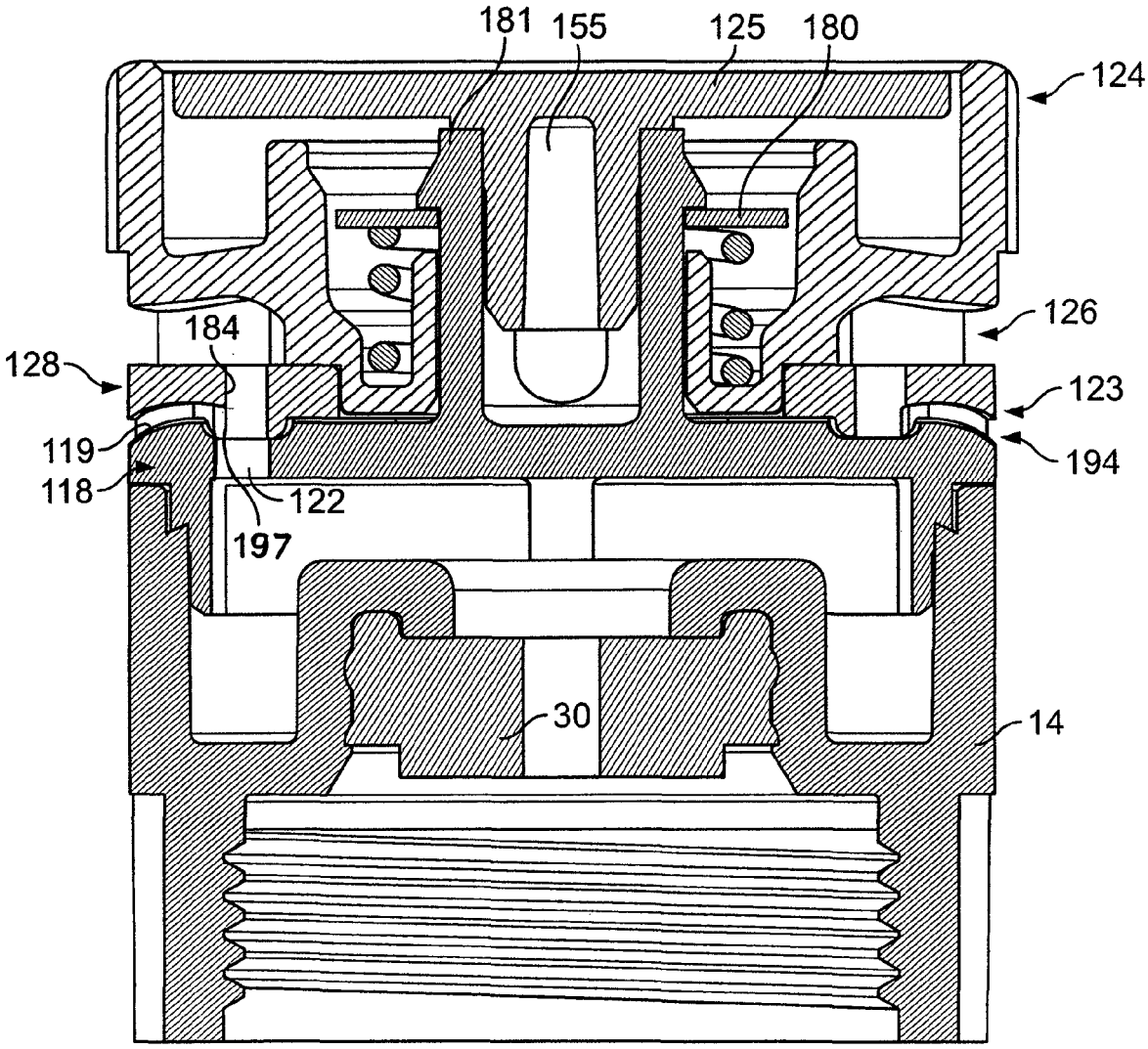
FIG. 11 is a cross-sectional view of the nozzle assembly of FIG. 9.

In this embodiment, as illustrated in FIGS. 10 and 11, the knob 124 is preferably divided into a knob portion 124*a* and an integral central retainer portion 124*b*, which is configured to hold a biasing mechanism 160. The biasing mechanism 160 includes a biasing member 178 and a retaining member 180, such as a flat washer. The holding member 180 interferes with a lower surface of outwardly extending flange(s) or barbs 181 on the post 156 to retain the biasing member 178 within the retainer portion 124*b*. The other end of the biasing member 178 seats in an annular seat 175 defined at the bottom of the central retainer portion 124*b*.

Other than the retainer portion 124*b* being integral with the control knob 124, the rotation and biasing of the control knob 124 function similar to that previously described with the nozzle assembly 10. For example, the biasing force provided by the biasing member 178 forces the control knob 124 downward toward the nozzle 118. To select a particular deflector 126 to be in fluid communication with the nozzle port 122, a user lifts the control knob 124 away from the nozzle 118 to counter bias the biasing member 178 and then rotates the control knob 124 either clockwise or counter-clockwise to position the desired deflector 126 in fluid communication with the nozzle port 122. Releasing the control knob 124 permits the biasing member 178 to again bias the control knob 124 downwardly toward the nozzle 118. The nozzle assembly 110 may also include the stopping members 86 to correctly position the control knob 124 and provide the audible "click" upon rotation and positioning.

In this embodiment, the control knob 124 also includes a cap 125 that is received in a central opening 159 of the control knob 124 as best illustrated in FIG. 11. The cap 125 has a generally flat disk 125*a* with a depending post 125*b* that extends from a lower surface 125*c* of the disk 125*a*. In one form, the post 125*b* has a diameter that permits a friction fit within the central space 155 between the two facing fingers 156*a* and 156*b* of the securing extension 156. In this manner, the post 125*b* prevents any inward flexing of the fingers 156*a* or 156*b*, which could allow the holding member 180 to slide past the outward flanges 181 on the post 156.

Figure 11A:
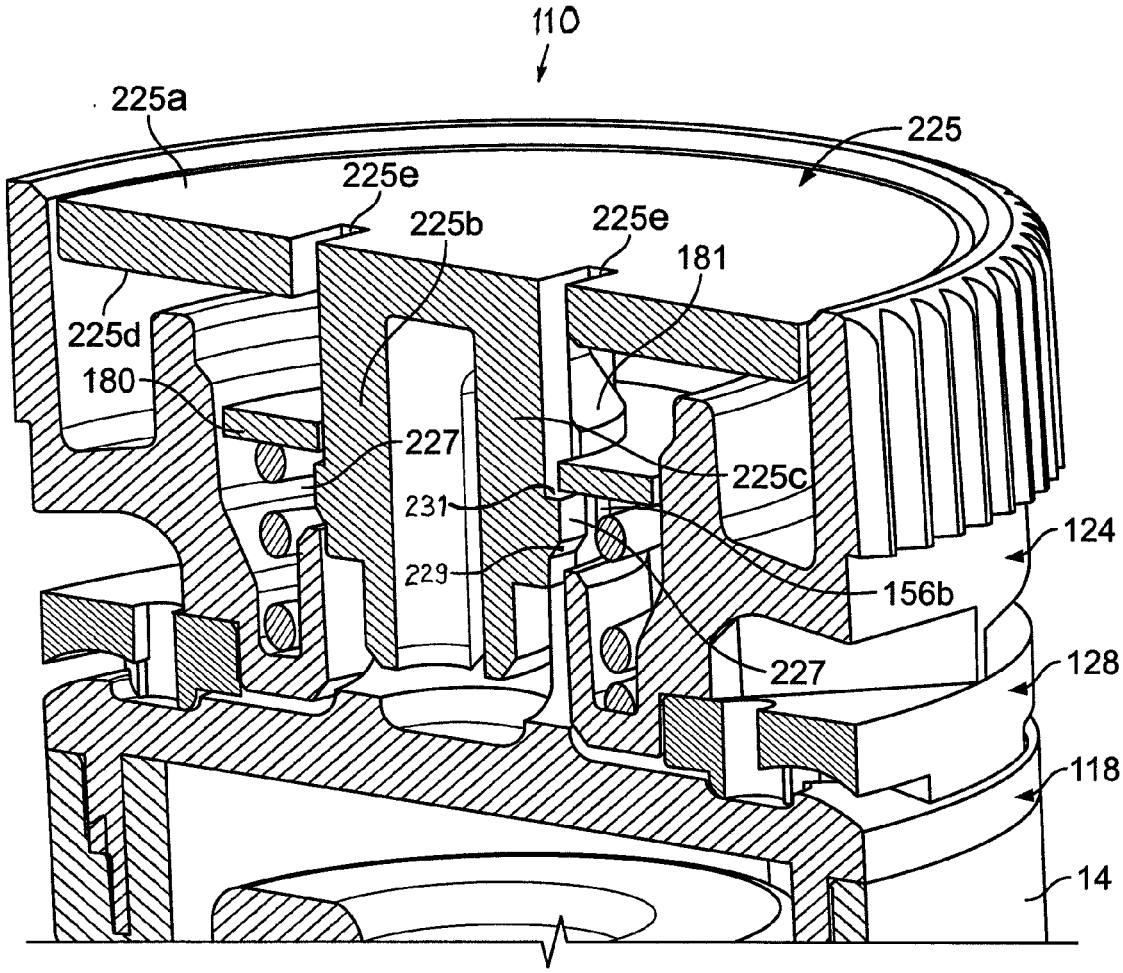
FIG. 11A is a cross-sectional view of the nozzle assembly of FIG. 9 shown with an alternative cap.
Figure 12:
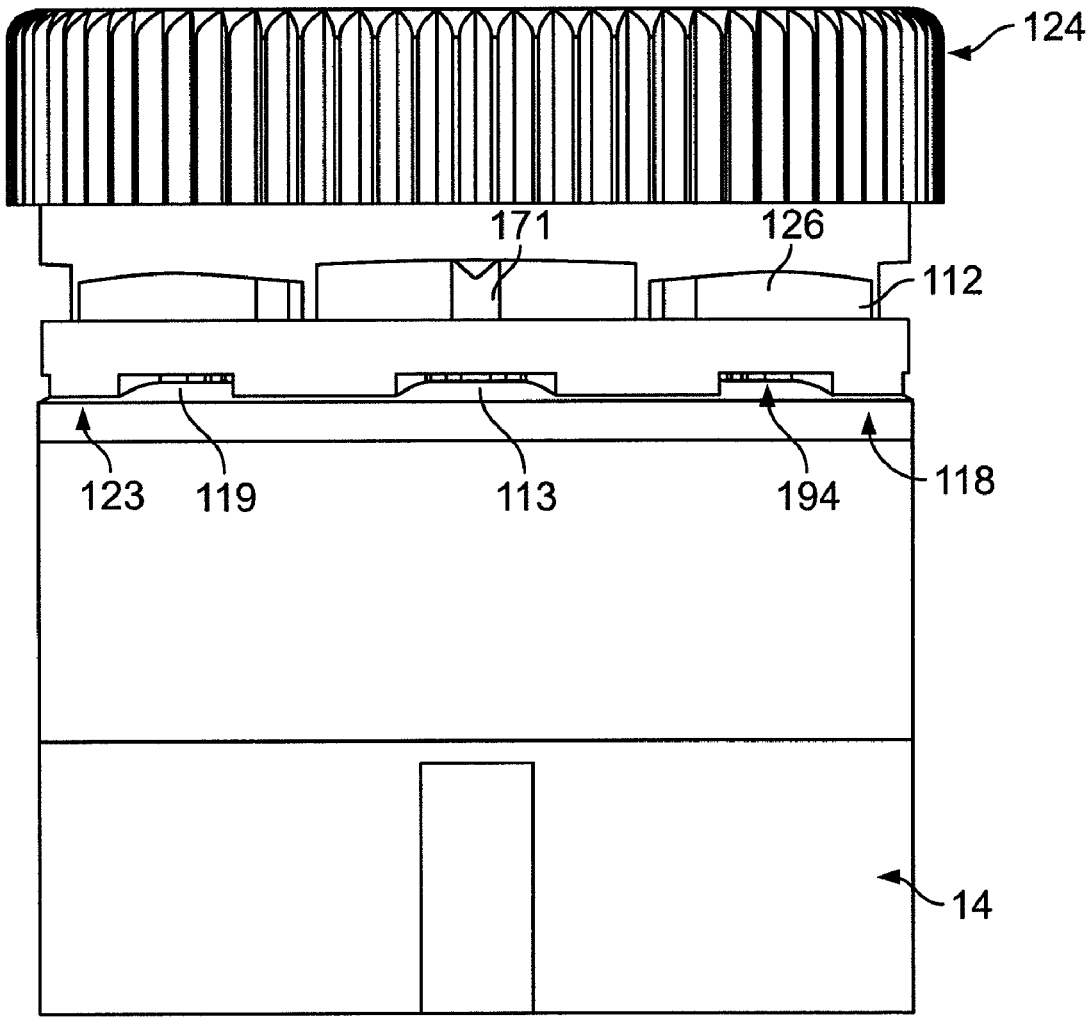
FIG. 12 is a side elevational view of the nozzle assembly of FIG. 9.

Referring to FIG. 11*a*, an alternative cap 225 is illustrated that utilizes a snap-fit configuration with the retaining member 180. In this form, the cap 225 includes an upper disk 225*a* and a pair of longitudinal extending arcuate fingers 225*b* and 225*c* that face one another and that depend from a lower surface 225*d* of the disk 225*a*. Each finger 225*b*, 225*c* includes an outwardly extending flange 227 therealong that, when assembled in the nozzle assembly 110, retains the cap 225 on the nozzle 110. The retaining member 180 is secured between the flange 227 of the cap fingers 225*b*, 225*c* and the outward flanges 181 of the nozzle post 156. That is, the lower surface of the retaining member 180 engages with the flange 227 and an upper surface of the retaining member 180 engages with the outward flanges 181 to secure the retaining member 180 therebetween.

When the cap 225 is installed in the nozzle 210 in this manner, the cap fingers 225*b*, 225*c* are staggered with the nozzle post fingers 156*a* and 156*b* such that each cap finger 225*b* and 225*c* is received in a space 156*c* (FIG. 10) defined between the nozzle post fingers 156*a* and 156*b*. The fingers 225*b* and 225*c* preferably flex inwardly during assembly. The flexing of the fingers 225*b* and 225*c* permit the flange 227 to be received past the retaining member 180 during insertion, and permit the fingers 225*b* and 225*c* to snap back to their original position once the flange 227 is past the retaining member 180 to thereby secure the cap 225 within the nozzle assembly 110.

More specifically, each flange 227 has a leading cam portion 229 that includes an angled surface that cams against the retaining member 180 to cause the fingers 225*b* and 225*c* to deflect inward so that the flange 227 can pass through the retaining member 180. Each flange 227 also includes a trailing barb portion 231 that engages the retaining member 180 once the flange 227 has passed through the retaining member 180 to resist unintentional detachment.

As the control knob 124 is rotated, the cap 125 or 225 remains stationary; therefore, the upper surface of the cap 125 or 225 may include printing, logos, instructions, or other writing for the benefit of a user or installer. While the cap 125 or 225 is illustrated on the nozzle assembly 110, the other nozzle assemblies described herein may also include a similar cap if desired. While a friction-fit or a snap-fit arrangement has been described to preferably retain the cap 125 or 225 in the nozzle assembly 110, if included, the cap may be coupled to the nozzle assembly using other coupling mechanisms as well.

The base plate or flow-control device 128 is positioned between a lower surface 164 of the control knob 124 and the nozzle 118 to minimize and, preferably, eliminates fluid leaking between a rotational interface 123 (FIGS. 12 and 13) between the control knob 124 and the nozzle 118 (FIG. 11). That is, similar to the base plate 28, the base plate 128 includes a plurality of secondary ports or throughbore 184 having a diameter larger than a diameter of the ports 122 to produce a pressure drop and vacuum effect upon fluid flowing upwardly through the ports 184 and 122.

Figure 13:
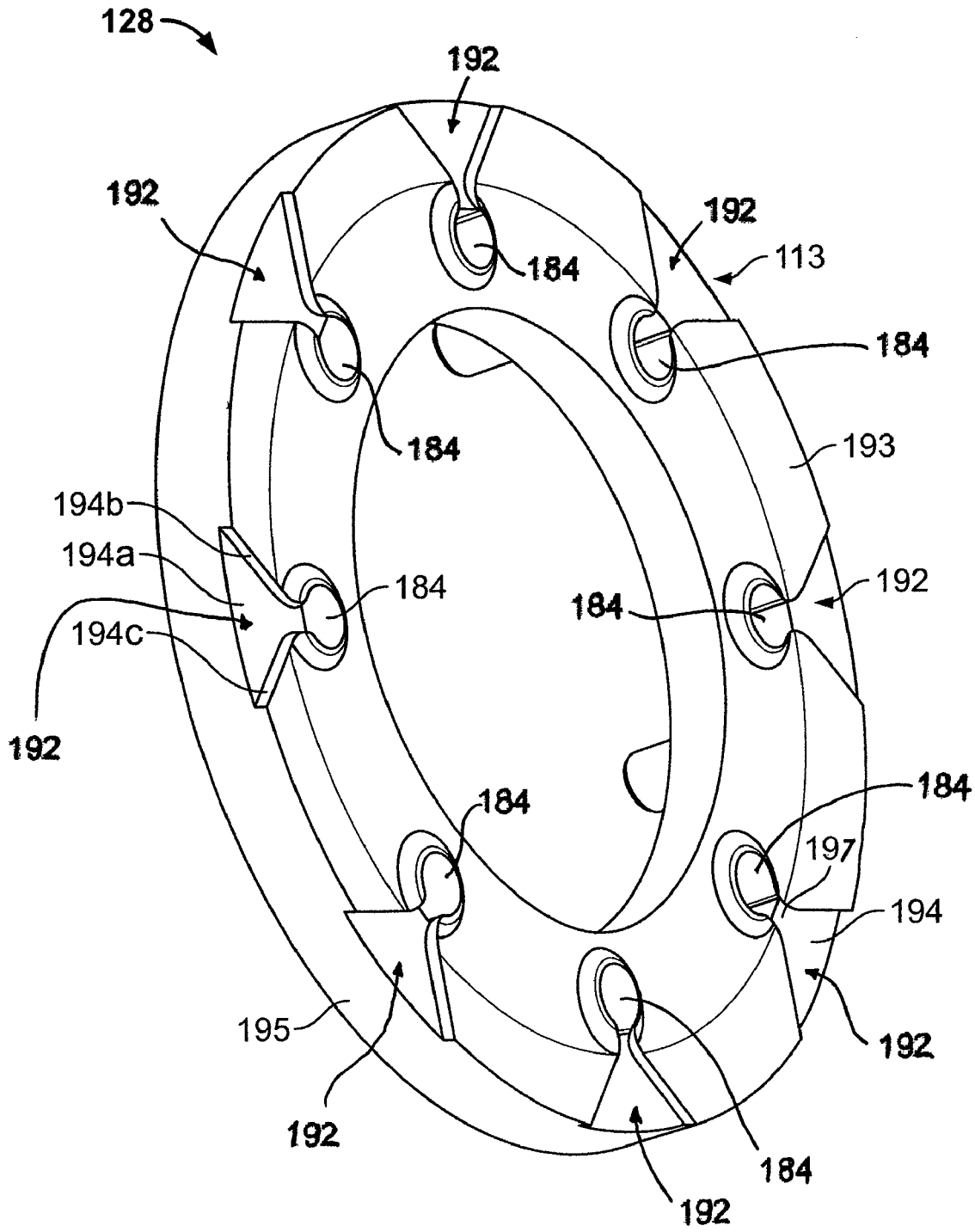
FIG. 13 is a perspective view of the base plate of the nozzle assembly of FIG. 9.
Figure 14:
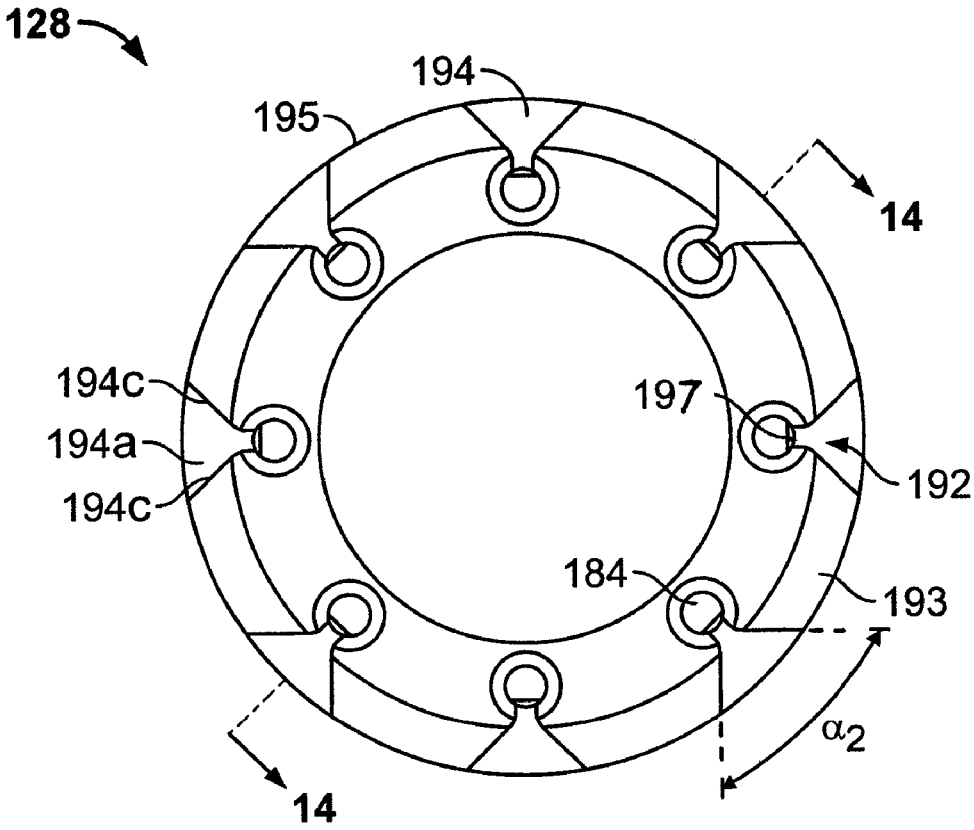
FIG. 14 is a bottom plan view of the base plate of FIG. 13.
Figure 15:
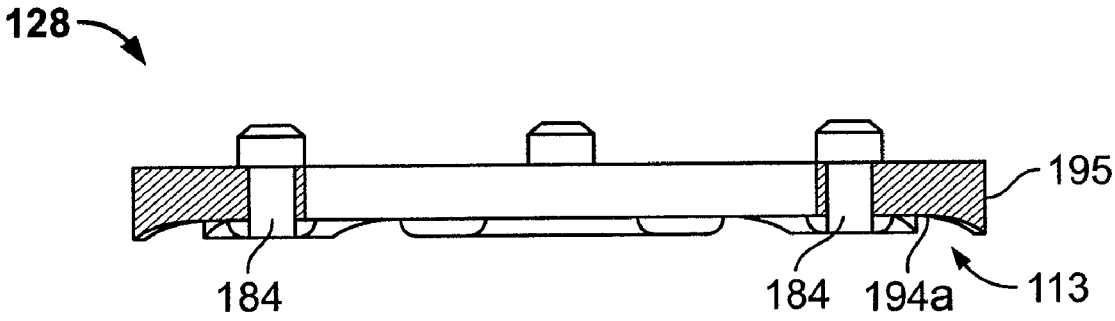
FIG. 15 is a cross-sectional view of the base plate of FIG. 14 taken along line 14-14 in FIG. 14.

Referring to FIGS. 13-15, the base plate 128 defines a plurality of deflector surfaces or deflectors 192 located on a lower surface 193 thereof. The deflectors 192 project a fluid spray under about 2 feet from the nozzle assembly 110 by siphoning a portion of the fluid flowing through the port 184 and redirecting such fluid to the deflectors 192.

Each deflector 192 is formed from a recess 194 that extends outwardly from the ports 184 to an outer edge 195 of the base plate 128. In one form, the recess 194 has a generally fluted shape defined by an upper wall 194*a* and facing side walls 194*b* and 196*c*. To project a fluid spray close-in to the nozzle assembly 110 (i.e., under about 2 feet), the upper wall 194*a* is generally curved downwardly as the recess 194 extends outwardly in a radial direction away from the ports 184 (FIG. 15). Preferably, the upper wall has a radius of curvature from about 0.10 to about 0.2 inches, which also substantially matches the radius of curvature of the outer portions 119 of the nozzle disk 154 (FIG. 10). To project a fluid spray about a quarter pattern, the facing side walls 194*b* and 194*c* of the deflector recess 192 generally form a sweep angle $\alpha 2$ of about 90° to about 100°.

Different spray patterns and distances can be obtained by varying the shapes and curves of the recess 194 as described above. As such, the details above are merely provided as one example to achieve one spray pattern and distance based on a nozzle about 6 inches above ground level. One skilled in the art will appreciate that the configuration of the recess may need to be altered if the nozzle extends a different height above ground level. Moreover, the shapes, angles, and geometry of the recess 194 can also be varied as desired to achieve other types of spray patterns and/or distances.

To siphon a portion of the fluid flowing through the ports 184, the deflectors 192 also preferably include a partial occlusion 197 extending inwardly into the bore 184. The occlusion 197 blocks a portion of the fluid flowing upwardly through the port 184, which redirects the fluid into the deflector 192. Depending on the amount of fluid to be redirected into the deflectors 192, the length of the occlusion 197 extending into the port 184 may be varied. For example, preferred occlusion 197 lengths range up to about 0.0105 inches, which will siphon up to about 25 percent of the fluid flowing through port 184 into the secondary spray nozzle 113. Of course, shorter or longer lengths may be used if more or less fluid is desired to be redirected into the secondary nozzle 113.

In nozzle assembly 110, as illustrated in FIGS. 10 and 11, each deflector 126 is aligned with each secondary deflector 194 so that both are in fluid communication with each other and fed fluid via the same port 184. Furthermore, such deflector combination (i.e., each main deflector 126 and associated secondary deflector 194), when selected through positioning of the knob 124, are also in fluid communication with the same nozzle port 122. That is, when the control knob 124 is positioned to select a particular deflector 126, the control knob 124 automatically also selects the secondary deflector 194 that is associated therewith because the base plate 128 is secured to the control knob 124 for rotation therewith. Preferably, the nozzle assembly 110 includes eight deflectors 194 on the base plate 128 and eight corresponding deflectors 126 on the control knob 124.

In operation, fluid under pressure flows upwardly through the nozzle port 122 and continues upwardly through the port 184. At this point, a portion of the fluid is diverted by the secondary deflector 194 and projected outwardly as a secondary fluid spray from the secondary spray nozzle 113 for close-in sprinkling. The remaining fluid continues upwardly through the port 184 and then projected outwardly as a primary fluid spray from the primary spray nozzle 112 for projecting a fluid extended distances.

Figure 16:
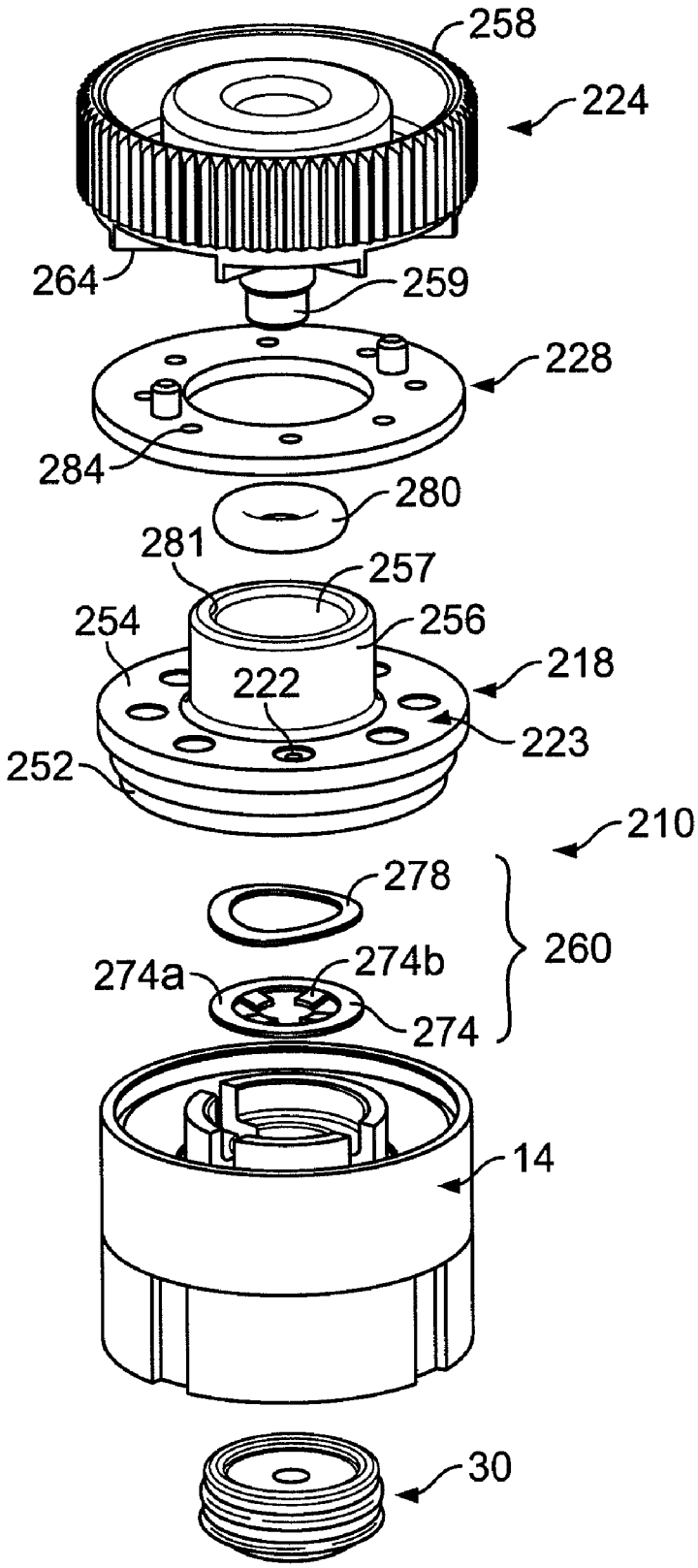
FIG. 16 is an exploded perspective view of another nozzle assembly for an irrigation sprinkler.

Referring to FIG. 16, there is illustrated a third embodiment of a spray nozzle assembly 210. Similar to the prior embodiments, the nozzle assembly 210 includes the base 14, and optionally, the secondary flow-control device 30. The nozzle assembly 210, however, also includes a modified nozzle 218, a modified base plate or flow-control device 228, and a modified control knob 224 because the control knob 224 is joined within the assembly 210 using a snap ring, for example.

For example, in this embodiment, the nozzle 218 has an upper disk 254 with a centrally located annular projection 256 extending upwardly from an upper surface 253 of the disk 254. The annular projection 256 defines a receiving bore 257 that extends through the nozzle 218. At a distal end of the projection 256, a flange 281 extends inwardly into the receiving bore 257 of the projection 256. The flange 281 secures a biasing mechanism 260 within the annular projection 256.

In this embodiment, the biasing mechanism 260 includes a biasing member 278, such as a spring washer, and a retaining member 274, such as a retainer clip, ring, or other securing member. As illustrated, the retaining member 274 includes an annular ring 274*a* with inwardly projecting, resilient grasping fingers 274*b*. As further described below, the retaining member 274 rotatably couples the control knob 224 to the nozzle 218 by grasping a portion of the control knob 224 that extends through the nozzle receiving bore 257.

Referring again to FIG. 16, the control knob 224 is a generally cylindrical member 258 that also includes a downwardly extending centrally located post 259 that is received through the bore 257 of the annular projection 256 and rotatably coupled to the nozzle 218 by the retaining member 274 of the biasing mechanism 260. To provide a substantially fluid-tight seal between the knob 224 and nozzle 218, the nozzle assembly 210 also includes a sealing member 280, such as an O-ring, that seals at the distal end of the annular projection 256 and also engages a control knob lower surface 264 when the control knob 224 is coupled to the nozzle 218.

The biasing mechanism 260 permits the control knob 224 to function in a manner similar to the previous embodiments. That is, for example, the biasing member 278 biases the control knob 224 downwardly towards the nozzle 218. When a user desires to rotate the control knob 224 similar to the other embodiments, the control knob 224 is lifted away from the nozzle 218 to counter bias the biasing member 278. Thereafter, the control knob 224 is repositioned in a manner similar to the previous embodiments. As with the other embodiments, the nozzle assembly 210 may also include the stopping members to rotationally align the control knob 224 to the nozzle 218 and provide the audible "click" upon rotation to indicate alignment.

The base plate or flow-control device 228 is similar to base plate 28. For instance, the base plate 228 is formed from a generally washer-shaped disk having throughbores 284 and portions of a stop member (i.e., recesses 88 or detents 89) thereon to rotationally position the base plate 228 about the nozzle 218. The base plate 228 also reduces, and preferably eliminates, any fluid leaking around through the nozzles. The base plate 228 is also secured to the knob 224 and rotates therewith.

In contrast, however, the base plate 228 does not include the clearances 90 along its outer periphery to form notches therein. The nozzle 218, therefore, provides an alternative base plate that can be used with any of the embodiments therein. On the other hand, with a sufficient biasing force from the biasing mechanism, any of the nozzle assemblies herein can also be used in a similar fashion without their respective flow-control devices if desired.

Figure 17:
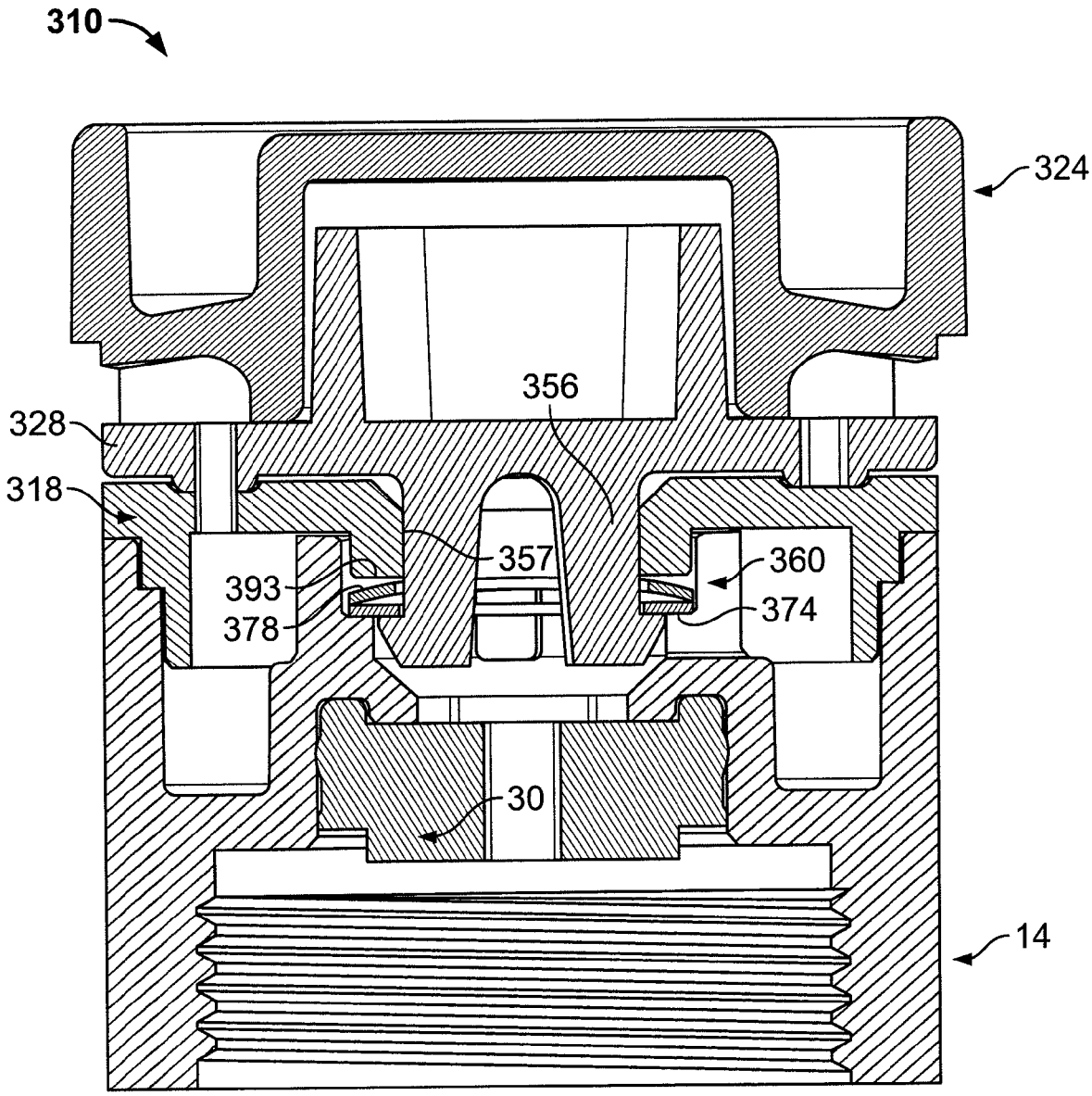
FIG. 17 is a cross-sectional view of another nozzle assembly for an irrigation sprinkler.

Referring to FIG. 17, there is illustrated a fourth embodiment of a spray nozzle assembly 310 which provides an alternative rotational coupling of a control knob 324 to a nozzle 318. The nozzle 318 defines a central opening 357 sized to receive a downwardly depending snap-finger 356 of a base plate or flow-control portion 328. The snap-finger 356 includes an outwardly extending annular flange 381 that retains a biasing mechanism 360 (i.e., biasing member 378, such as a spring washer, and retaining member 374, such as a retainer clip, ring, or other securing member, similar to prior embodiments) between the flange 381 and a lower surface 393 of the nozzle 318. Other than such differences in the rotational coupling, then nozzle assembly 310 preferably functions in a similar manner to the previous embodiments.

It will be understood that various changes in the details, materials, and arrangements of parts and components which have been herein described and illustrated in order to explain the nature of the invention may be made by those skilled in the art within the principle and scope of the invention as expressed in the appended claims. Furthermore, while various features have been described with regard to a particular embodiment, it will be appreciated that features described for one embodiment may also be incorporated with the other described embodiments.

What is claimed is:

1. A spray nozzle assembly having a longitudinal axis and for irrigation comprising:

a base configured to communicate with a supply of fluid, the base having the longitudinal axis extending through a center thereof;

a nozzle fixedly coupled to the base in a non-rotating manner, the nozzle including an upper disk portion extending transverse to the longitudinal axis and defining a fluid passage therein, the fluid passage extending in an axial direction and configured to provide an upwardly directed axial flow;

a first deflector downstream of the nozzle and having a shape configured to redirect fluid from the fluid passage to project fluid with a first predetermined spray pattern;

a second deflector separate from the first deflector and positioned downstream of the nozzle and having a different shape configured to redirect fluid from the fluid passage to project fluid with a second, different predetermined spray pattern;

a control knob selector coupled to the first deflector and the second, separate deflector, the control knob selector mounted for rotation relative to the nozzle about the central longitudinal axis and having a first position of the control knob to orient a portion of the first deflector in fluid communication with the fluid passage in an axial direction for projecting the first predetermined spray pattern from the spray nozzle assembly and a second position of the control knob to orient a portion of the second, separate deflector in fluid communication with the same fluid passage in an axial direction for projecting the second predetermined spray pattern from the spray nozzle assembly, the control knob selector shiftable about the central longitudinal axis to switch between the first predetermined spray pattern and the second predetermined spray pattern;

wherein the first and second deflector surfaces are disposed on the control knob selector;

wherein the control knob selector comprises a plurality of predetermined rotary positions relative to the upper disk portion of the nozzle, the first deflector being in fluid communication with the upper disk portion fluid passage at one of the plurality of predetermined rotary positions, and the second deflector being in fluid communication with the upper disk portion fluid passage at another of the plurality of predetermined rotary positions; and wherein the longitudinal axis extends through the upper disk portion of the nozzle plate and the control knob selector, and wherein the control knob selector is rotatable about the longitudinal axis to select one of the plurality of predetermined rotary positions.

2. The spray nozzle assembly of claim 1, wherein each of the plurality of the predetermined rotary positions of the control knob selector are defined by a detent being received in a recess.

3. The spray nozzle assembly of claim 2, wherein the detent extends from one of the control knob selector or the upper disk portion of the nozzle, and the recess is defined in the other of the control knob selector or the upper disk portion of the nozzle.

4. The spray nozzle assembly of claim 1, further comprising a biasing mechanism to bias the control knob selector toward the upper disk portion of the nozzle.

5. The spray nozzle of claim 1, wherein the biasing mechanism includes a spring, a retainer to house at least a portion of the spring, and a securing member to retain at least a portion of the spring within the retainer.

6. The spray nozzle of claim 1, further comprising a plurality of the first deflector and a plurality of the second deflector and wherein the first deflectors and the second deflectors alternate around the control knob selector.

7. The spray nozzle of claim 1, further comprising a base plate being disposed between the control knob selector and the upper disk portion of the nozzle configured to minimize fluid leaking between the nozzle and the control knob selector.

8. The spray nozzle of claim 7, wherein the fluid passage of the upper disk portion of the nozzle has a first diameter and the base plate defines a fluid bore configured to be in fluid communication with the fluid passage of the upper disk portion, the fluid bore having a second diameter that is larger than the first diameter to form a pressure drop at an interface between the upper disk portion and the second plate to minimize fluid leakage therebetween.

9. The sprinkler of claim 7, wherein the first and second deflectors each being a recessed portion disposed on a lower side of the control knob selector.

10. The sprinkler of claim 9, wherein the first and second deflectors each define a notch in a wall of the recess.

11. The sprinkler of claim 7, wherein the base plate defines notches on an outer edge thereof such that the base plate does not interfere with either the first or second spray patterns.

12. The sprinkler of claim 1, further comprises a pressure compensating gasket constructed from a resilient material disposed in the base, the pressure compensating gasket defining a variable aperture extending therethrough, and the resilient material deforming a size of the variable aperture in response to a fluid pressure.

* * * * *